US012281835B2

(12) United States Patent
Kim et al.

(10) Patent No.: US 12,281,835 B2
(45) Date of Patent: Apr. 22, 2025

(54) REFRIGERATOR

(71) Applicant: LG Electronics Inc., Seoul (KR)

(72) Inventors: Ki Hwang Kim, Seoul (KR); Ho Jin Choi, Seoul (KR); Dong Hwi Kim, Seoul (KR); Sung Hee Kang, Seoul (KR); Sang Ho Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 261 days.

(21) Appl. No.: 17/800,715

(22) PCT Filed: Jan. 21, 2021

(86) PCT No.: PCT/KR2021/000811
§ 371 (c)(1),
(2) Date: Aug. 18, 2022

(87) PCT Pub. No.: WO2021/187741
PCT Pub. Date: Sep. 23, 2021

(65) Prior Publication Data

US 2023/0349622 A1 Nov. 2, 2023

(30) Foreign Application Priority Data

Mar. 17, 2020 (KR) ..... 10-2020-0032806

(51) Int. Cl.
*F25D 17/06* (2006.01)

(52) U.S. Cl.
CPC ..... *F25D 17/065* (2013.01); *F25D 2317/067* (2013.01); *F25D 2317/0682* (2013.01)

(58) Field of Classification Search
CPC ..... F25D 17/065; F25D 2317/067; F25D 2317/0682; F25D 17/08
See application file for complete search history.

(56) References Cited

U.S. PATENT DOCUMENTS

2012/0096887 A1* 4/2012 Cho ..... F25D 21/08 62/276
2021/0262718 A1* 8/2021 Burlingham ..... F25D 17/065

FOREIGN PATENT DOCUMENTS

CN 107388699 A 11/2017
EP 3835693 6/2021
(Continued)

OTHER PUBLICATIONS

Extended European Search Report in European Appln. No. 21771859.2, mailed on Feb. 20, 2024, 8 pages.

*Primary Examiner* — Ana M Vazquez
(74) *Attorney, Agent, or Firm* — Fish & Richardson P.C.

(57) ABSTRACT

A refrigerator includes a refrigerating compartment, a freezing compartment, and an ice-making compartment. The refrigerating compartment is configured to receive cool air from a refrigerating compartment side grille fan assembly, and the ice-making compartment is configured to be located any one refrigerating compartment door and to receive cool air from a freezing compartment side grille fan assembly with the freezing compartment. The refrigerating compartment side grille fan assembly is configured to supply a greater amount of cool air to the side where the ice-making compartment and the refrigerating compartment side grille fan assembly are located, and to perform cool air supply proportional to temperature influence provided from the ice-making compartment and the refrigerating compartment side grille fan assembly.

20 Claims, 34 Drawing Sheets

(56) References Cited

FOREIGN PATENT DOCUMENTS

| | | | | |
|---|---|---|---|---|
| KR | 20110006996 | A | | 1/2011 |
| KR | 20180080652 | A | * | 7/2018 |

* cited by examiner

REFRIGERATOR

CROSS-REFERENCE TO RELATED APPLICATIONS

This application is a National Stage application under 35 U.S.C. § 371 of International Application No. PCT/KR2021/000811, filed on Jan. 21, 2021, which claims the benefit of Korean Patent Application No. 10-2020-0032806, filed on Mar. 17, 2020. The disclosures of the prior applications are incorporated by reference in their entirety.

TECHNICAL FIELD

The present disclosure relates to a refrigerator having a refrigerating compartment and a freezing compartment that provide respective storage spaces, with an ice-making compartment being provided in a refrigerating compartment door.

BACKGROUND ART

In general, a refrigerator is a home appliance that is provided to store various foods or beverages for a long time by cool air generated by circulation of a refrigerant according to a refrigeration cycle.

The refrigerator is configured of one or a plurality of partitioned storage compartments for cooling a stored item. Each of the storage compartments may be opened or closed by a rotary type door, or may be ejected and retracted or store in a drawer manner.

In particular, the storage compartments may include a freezing compartment for freezing the stored item and a refrigerating compartment for refrigerating the stored item. In addition, the storage compartments may include at least two freezing compartments or at least two refrigerating compartments.

In recent refrigerators, an ice-making compartment is provided in a refrigerating compartment door so that a user can take out ice without opening the freezing compartment.

That is, cool air passed through an evaporator in a cabinet is supplied to the refrigerating compartment door through a cool air duct for the ice-making compartment. When the refrigerating compartment door is closed, the cool air is supplied to the ice-making compartment through a connection flow path provided in the refrigerating compartment door and the cool air duct for the ice-making compartment.

The above refrigerator has been variously proposed in Korean Patent No. 10-1718995 (related art 1), Korean Patent Application Publication No. 10-2018-0057717 (related art 2), Korean Patent No. 10-1659622 (related art 3), and Korean Patent Application Publication No. 10-2009-0101525 (related art 4).

However, in the related arts, a flow path from the freezing compartment to the ice-making compartment is configured to be long. Therefore, an ice-making fan module for supplying cool air to the ice-making compartment and a freezing fan module for supplying cool air to the freezing compartment cannot use the same type of fan, so there is a problem in that the communalization and standardization of a fan cannot be realized.

Meanwhile, in the refrigerator having the ice-making compartment at the refrigerating compartment door, a freezing fan module and an ice-making fan module are provided separately and then coupled to a shroud of a freezing compartment side grille fan assembly.

In particular, the ice-making fan module includes a flow path for guiding cool air to the ice-making compartment. The above structure has been proposed in the above-described related arts 3 and 4, and in Korean Patent Application Publication No. 10-2017-0133840 and Korean Patent No. 10-0918445.

However, a grille fan assembly provided by coupling the separate ice-making fan module to the shroud as described above has a problem in assembling in that the ice-making fan module should be additionally assembled. Further, in the process of installing the ice-making module in the grille fan assembly, there is a problem in that a fan duct does not match with a cool air duct for the ice-making compartment due to a coupling error between the ice-making fan module and the grille fan assembly.

The freezing compartment side grille fan assembly according to the related art is configured to divide a cool air flow path for the ice-making compartment (flow path for guiding cool air flowing by the ice-making fan module and a cool air flow path for the freezing compartment (flow path for guiding cool air flowing by the freezing fan module) from each other.

Therefore, conventionally, backflow of cool air in the cool air flow path for the ice-making compartment occurs toward the side where the freezing fan module is located during independent operation of the freezing fan module. In addition, backflow of cool air in the cool air flow path for the freezing compartment occurs toward the side where the ice-making fan module is located during independent operation of the ice-making fan module.

In particular, the cool air flow path for the ice-making compartment communicates with the refrigerating compartment through the cool air duct for the ice-making compartment. Whereby, condensed water is generated due to backflow of cool air in the refrigerating compartment having relatively high temperature to the ice-making fan during independent operation of the freezing fan module. Due to the condensed water, there is a problem in that an operation defect such as freezing of the ice-making fan occurs.

Conventionally, various efforts have been carried out for removing condensed water in a portion where the ice-making fan module is located or for preventing the freezing of the condensed water.

However, despite the above efforts, a structure that prevents the backflow of cool air from the cool air duct for the ice-making compartment or a structure for quickly removing the condensed water flowing into the ice-making fan module is not provided in the refrigerator, so the above problems still remain.

Recently, as the number of frozen storage items increases, the use of the freezing compartment is increased, and thus the area of freezing compartment is also increased.

Accordingly, in recent years, the freezing compartment is divided into a plurality of spaces so that the stored item may be respectively stored in a plurality of layers of shelves or a plurality drawer boxes.

However, in the refrigerator having the plurality of drawer boxes as in the related art, there is a problem in that cool air is not sufficiently supplied to a storage box provided in a freezing compartment door.

DISCLOSURE

Technical Problem

Accordingly, the present disclosure has been made keeping in mind the above problems occurring in the related art, and the present disclosure is intended to propose a refrigerator having a new-type freezing compartment side grille fan assembly to prevent freezing of an ice-making fan due to cool air in a refrigerating compartment flowing backward to the ice-making fan during operation of the refrigerator having an ice-making compartment in a refrigerating compartment door.

Another objective of the present disclosure is to provide a refrigerator having a new-type freezing compartment side grille fan assembly configured to realize communalization between a freezing fan module for supplying cool air to a freezing compartment and an ice-making fan module for supplying cool air to an ice-making compartment.

A further objective of the present disclosure is to provide a refrigerator having a new-type freezing compartment side grille fan assembly to efficiently discharge condensed water or moisture present on an installation portion of an ice-making fan module to the outside of a freezing compartment, thereby preventing freezing of the ice-making fan module.

A further objective of the present disclosure is to provide a refrigerator having a new-type freezing compartment side grille fan assembly, wherein a cool air flow path for an ice-making compartment and a cool air flow path for a freezing compartment are configured to share cool air with each other and to prevent interference in a cool air flow caused when cool air flows from the cool air flow path for the ice-making compartment to the cool air flow path for the freezing compartment, so that cool air is sufficiently supplied to the entire portion in the freezing compartment.

Technical Solution

In order to achieve the above objectives, a refrigerator of the present disclosure may be configured such that a cool air flow path for a freezing compartment and a cool air flow path for an ice-making compartment provided in a refrigerating compartment side grille fan assembly may share cool air with each other through a shared flow path, and an open portion at a cool air outlet side of the shared flow path may be formed not to face a freezing fan module. Accordingly, as cool air is shared between the two cool air flow paths by the shared flow path, a greater amount of cool air may be supplied to the freezing compartment and backflow of cool air in a freezing compartment during independent operation of the ice-making fan may be prevented.

In the refrigerator of the present disclosure, the cool air flow path for the freezing compartment and the cool air flow path for the ice-making compartment may be formed on any one of facing surfaces between a grille fan and a shroud. Accordingly, compared to the related art in which a separate duct for an ice-making fan is coupled to the shroud, the refrigerator may have a simple structure and difficulty or defects during assembly may be prevented.

In the refrigerator of the present disclosure, a cool air outlet for an upper compartment, a cool air outlet for a middle compartment, and a cool air outlet for a lower compartment may be formed on the grille fan. Accordingly, cool air may be discharged to each of the upper, middle, and lower compartments in the freezing compartment.

In the refrigerator of the present disclosure, the cool air outlet for the upper compartment and the cool air outlet for the middle compartment may be formed in tube bodies protruding toward the inside of the freezing compartment. Accordingly, cool air may be supplied to a front space in the freezing compartment.

In the refrigerator of the present disclosure, in each of the cool air outlet for the upper compartment and the cool air outlet for the middle compartment, a wall surface adjacent to a freezing fan of opposite wall surfaces may be formed to be inclined or rounded. Accordingly, during the operation of the freezing fan, cool air flowing in a circumferential direction of the freezing fan may flow through the cool air outlet for the upper compartment and then be efficiently discharged to the upper compartment in the freezing compartment.

In the refrigerator of the present disclosure, a part of grilles formed on the cool air outlet may be formed to be inclined toward a side wall surface in the freezing compartment. Accordingly, the cool air discharged through the cool air outlet may flow to the front in the freezing compartment along opposite side wall surfaces in the freezing compartment and be supplied to stored items stored in storage boxes of a wall surface of a freezing compartment door.

In the refrigerator of the present disclosure, a first inlet hole in which the freezing fan is installed may be formed by penetrating the cool air flow path for the freezing compartment and a second inlet hole in which the ice-making fan is installed may be formed by penetrating the cool air flow path for the ice-making compartment at the side of the cool air flow path for the freezing compartment. Accordingly, the cool air flow path for the freezing compartment and the cool air flow path for the ice-making compartment may be simultaneously formed on the single shroud.

In the refrigerator of the present disclosure, the cool air flow path for the freezing compartment may have a recessed structure having an upper wall surface, a lower wall surface, and a first side wall surface, and a second side wall surface. Accordingly, cool air may flow along the wall surfaces.

In the refrigerator of the present disclosure, the cool air flow path for the ice-making compartment may be configured to protrude outward by penetrating the first side wall surface. Accordingly, the cool air flow path for the ice-making compartment may be configured to have a flow path of a predetermined length in a horizontal direction.

In the refrigerator of the present disclosure, an upper guide may be provided on the upper wall surface in the cool air flow path for the freezing compartment. Accordingly, a flow of cool air blown toward the upper side while flowing into the cool air flow path for the freezing compartment through the first inlet hole may flow toward the opposite sides in the freezing compartment.

In the refrigerator of the present disclosure, the upper guide may have an inverted triangle structure. Accordingly, a flow of cool air flowing along the upper guide may be stable.

In the refrigerator of the present disclosure, a vertex portion of the upper guide may be located to deviate from center of the first inlet hole toward the second side wall surface. Accordingly, a greater amount of cool air may be supplied to a space at one side with a recovery duct for the ice-making compartment in the freezing compartment than a space at the opposite side.

In the refrigerator of the present disclosure, a lower guide may be provided on the lower wall surface in the cool air flow path for the freezing compartment. Accordingly, a flow of cool air flowing into the cool air flow path for the freezing compartment through the first inlet hole and blown to the lower side may flow to the opposite sides in the freezing compartment.

In the refrigerator of the present disclosure, the lower guide may have a triangle structure. Accordingly, a flow of cool air flowing along the lower guide may be stable.

In the refrigerator of the present disclosure, the vertex of the lower guide may be located to deviate from center of the first inlet hole toward the first side wall surface. Accordingly, a greater amount of cool air may be supplied to the space at one side with the recovery duct for the ice-making compartment in the freezing compartment than the space at the opposite side.

In the refrigerator of the present disclosure, a side guide may be provided in the second side wall surface in the cool air flow path for the freezing compartment. Accordingly, a flow of cool air flowing into the cool air flow path for the freezing compartment through the first inlet hole and blown sideways may flow toward the upper and lower sides.

In the refrigerator of the present disclosure, two suction guides provided on both lower ends of the grille fan may be formed to have different opening sizes. Accordingly, cool air in a space having a relatively higher temperature of the opposite spaces in the freezing compartment may be rapidly recovered.

In the refrigerator of the present disclosure, the shared flow path may include an upper shared flow path. Accordingly, during the operation of the ice-making fan, a part of cool air flowing in the cool air flow path for the ice-making compartment may be supplied to an upper space in the cool air flow path for the freezing compartment.

In the refrigerator of the present disclosure, a flow path rib may be formed. Accordingly, the cool air flow path for the freezing compartment and the cool air flow path for the ice-making compartment may be separated from each other by the flow path rib.

In the refrigerator of the present disclosure, the upper shared flow path may be formed at any one portion of the flow path rib. Accordingly, the upper shared flow path may be formed by molding the flow path rib.

In the refrigerator of the present disclosure, the flow path rib may include a first circumferential flow path rib surrounding an upper circumference of an ice-making fan module and a second circumferential flow path rib surrounding a lower circumference of the ice-making fan module. Accordingly, the cool air flow path for the ice-making compartment may be defined by the two circumferential flow path ribs.

In the refrigerator of the present disclosure, a lower end of the first circumferential flow path rib and an upper end of the second circumferential flow path rib may be formed to be spaced apart from each other. Accordingly, the upper shared flow path may be defined by a space between the two ends of the two circumferential flow path ribs.

In the refrigerator of the present disclosure, the upper end of the second circumferential flow path rib may be formed to surround an outer circumferential surface of the lower end of the first circumferential flow path rib. Accordingly, the upper shared flow path may discharged cool air to an upper surface at any one side in the cool air flow path for the freezing compartment.

In the refrigerator of the present disclosure, the upper end of the second circumferential flow path rib may be formed to be located higher than an upper surface height of the freezing fan. Accordingly, cool air blown in a radial direction of the freezing fan by the operation of the freezing fan may be prevented from interfering with the cool air discharge due to a backflow into the upper shared flow path through a cool air outlet of the shared flow path.

In the refrigerator of the present disclosure, the upper end of the second circumferential flow path rib may be configured to be spaced apart from the lower end of the first circumferential flow path rib as the second circumferential flow path rib goes upward. Accordingly, a discharge speed of cool air supplied to the cool air flow path for the freezing compartment through the upper shared flow path may be reduced, thereby preventing interference with a flow of cool air flowing along the cool air flow path for the freezing compartment.

In the refrigerator of the present disclosure, a lower shared flow path may be provided. Accordingly, a part of cool air generated in the cool air flow path for the ice-making compartment may be provided to an extension flow path.

In the refrigerator of the present disclosure, the lower shared flow path may be provided by spacing a lower end of the second circumferential flow path rib apart from a wall surface of opposite wall surfaces of the cool air flow path for the freezing compartment. Accordingly, cool air supplied through the lower shared flow path may flow along the wall surface of the cool air flow path for the freezing compartment.

In the refrigerator of the present disclosure, the lower end of the second circumferential flow path rib may be formed to be bent in a direction parallel to the wall surface. Accordingly, the lower shared flow path may have a predetermined length so that cool air passing through the lower shared flow path may efficiently flow along the side wall surface of the shroud.

Advantageous Effects

As described above, the shared flow paths are provided in the refrigerator of the present disclosure, so that the cool air flow path for the freezing compartment and the cool air flow path for the ice-making compartment are shared with each other. Accordingly, even when the freezing fan and the ice-making fan are operated at the same time, sufficient cool air can be supplied to the freezing compartment, and when only the ice-making fan is operated, the backflow of cool air from the freezing compartment can be prevented.

The refrigerator of the present disclosure is configured such that an open portion of the cool air outlet side of the shared flow path does not face the freezing fan module. Accordingly, there is an effect that the cool air provided from the cool air flow path for the ice-making compartment through the shared flow path can efficiently supply to each portion of the freezing compartment without interfering with the flow of the cool air flowing in the cool air flow path for the freezing compartment.

The refrigerator of the present disclosure is configured such that the cool air flow path for the ice-making compartment is integrally formed on the shroud with the cool air flow path for the refrigerating compartment. Accordingly, as the cool air flow paths are designed in consideration of the structure of each fan module, the communalization of the ice-making fan module and the freezing fan module can be realized.

The refrigerator of the present disclosure is configured such that the lower shared flow path is formed in a lower surface (the second circumferential flow path rib) of the installation portion of the ice-making fan module, and the extension flow path extended to the lower compartment of the freezing compartment is additionally formed in the shroud. Accordingly, cool air can be sufficiently supplied to the lower compartment of the freezing compartment. In particular, the drainage hole is additionally formed in the extension flow path, and the lower shared flow path is formed by penetrating between the second circumferential flow path rib and the wall surface of the shroud. Accordingly, there is an effect that condensed water or moisture in the installation portion of the ice-making fan module can be efficiently discharged to the outside of the freezing compartment.

The refrigerator of the present disclosure is configured to have the guide formed on each wall surface in the cool air flow path for the freezing compartment, so that the cool air flowing in the cool air flow path for the freezing compartment can be supplied differently for each portion in the freezing compartment. Accordingly, there is an effect that the freezing efficiency can be improved.

MODE FOR INVENTION

Hereinbelow, a refrigerator according to an exemplary embodiment of the present disclosure will be described with reference to accompanying FIGS. 1 to 34.

Figure 1:
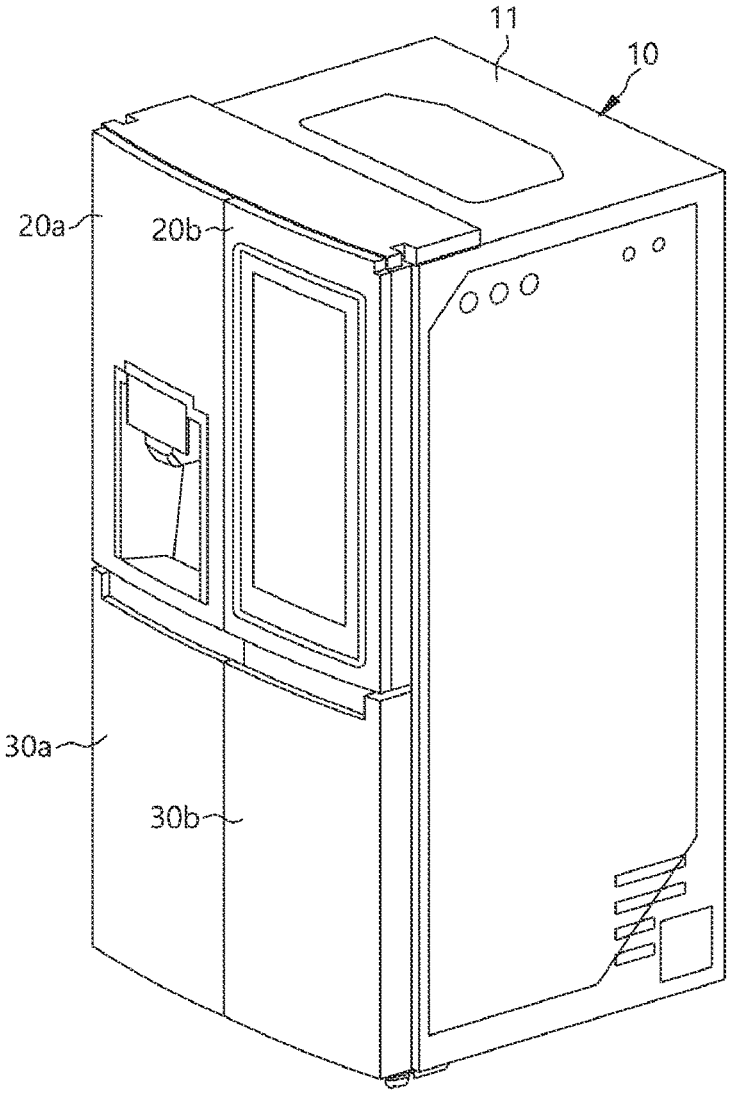
FIG. 1 is a perspective view showing an external structure of a refrigerator according to an embodiment of according to an embodiment of the present disclosure.
Figure 2:
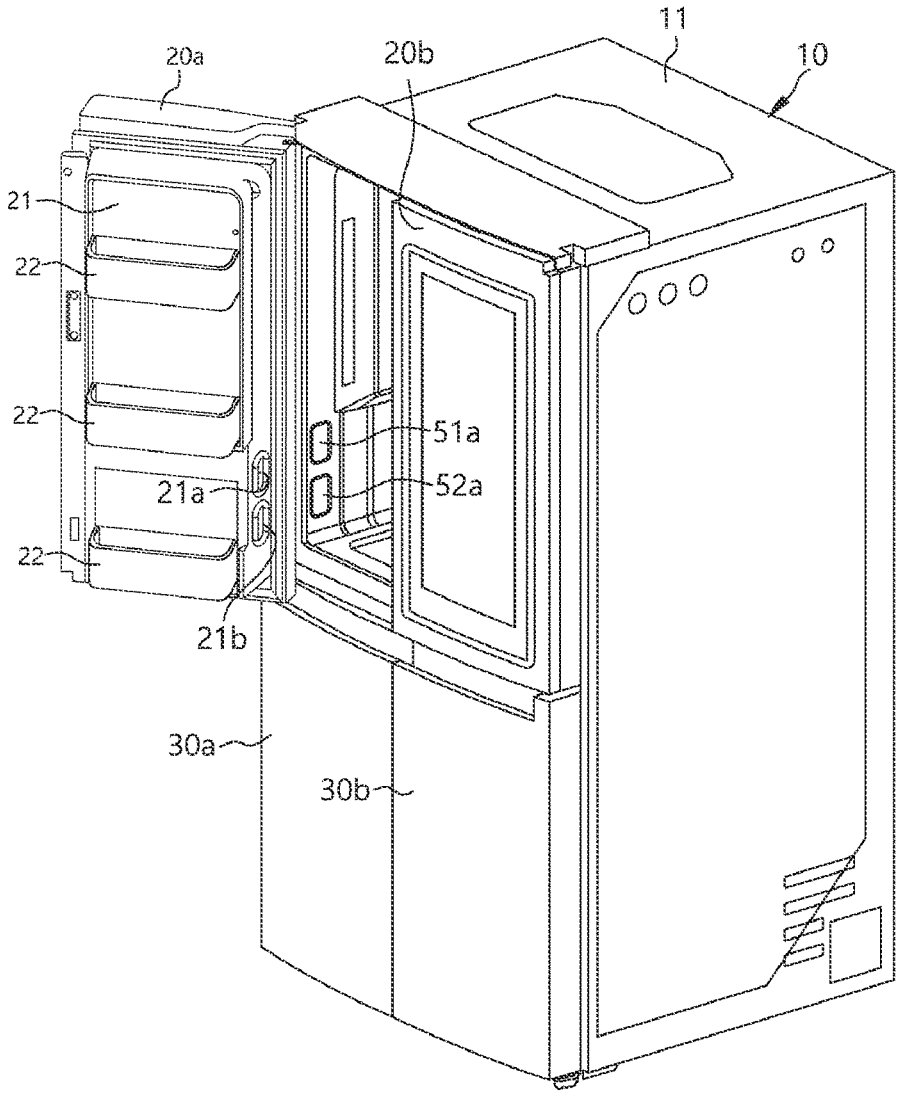
FIG. 2 is a perspective view showing a refrigerating compartment door with an ice-making compartment of the refrigerator according to the embodiment of the present disclosure in an opened state.

FIG. 1 is a perspective view showing an external structure of a refrigerator according to an embodiment of according to an embodiment of the present disclosure. FIG. 2 is a perspective view showing a refrigerating compartment door with an ice-making compartment of the refrigerator according to the embodiment of the present disclosure in an opened state.

Figure 3:
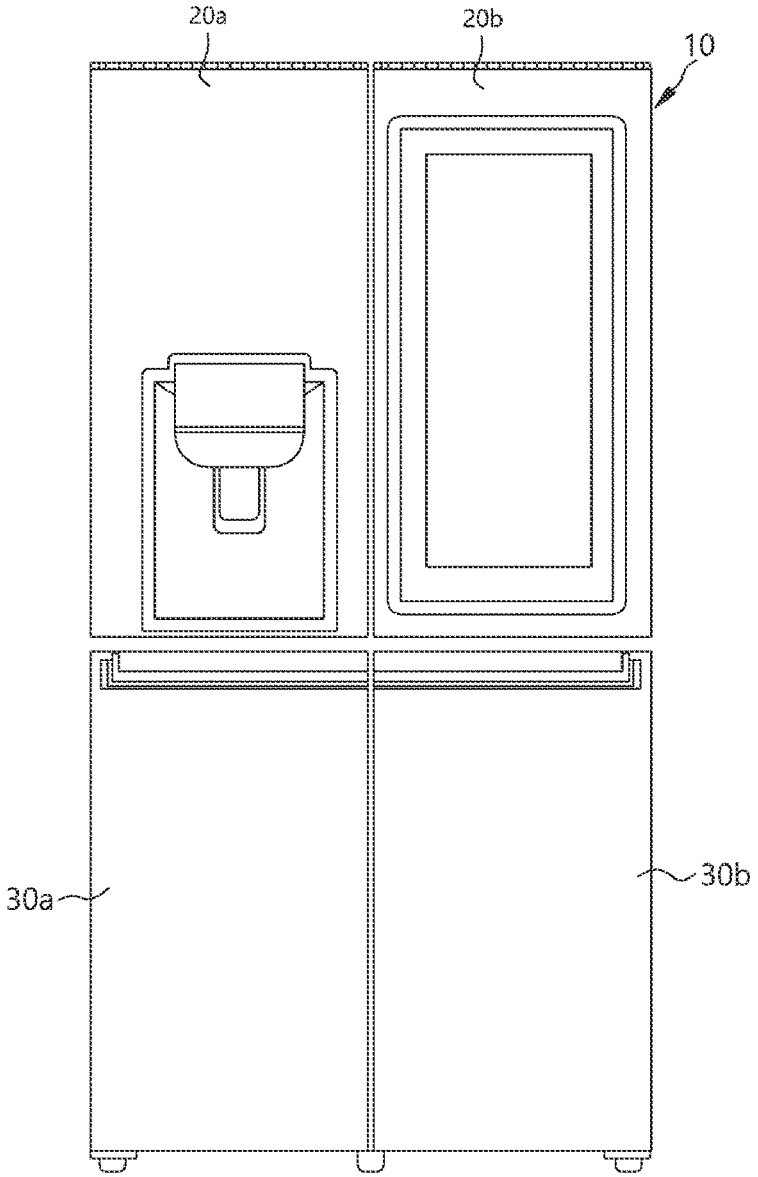
FIG. 3 is a front view schematically showing an internal structure of the refrigerator according to the embodiment of the present disclosure.
Figure 4:
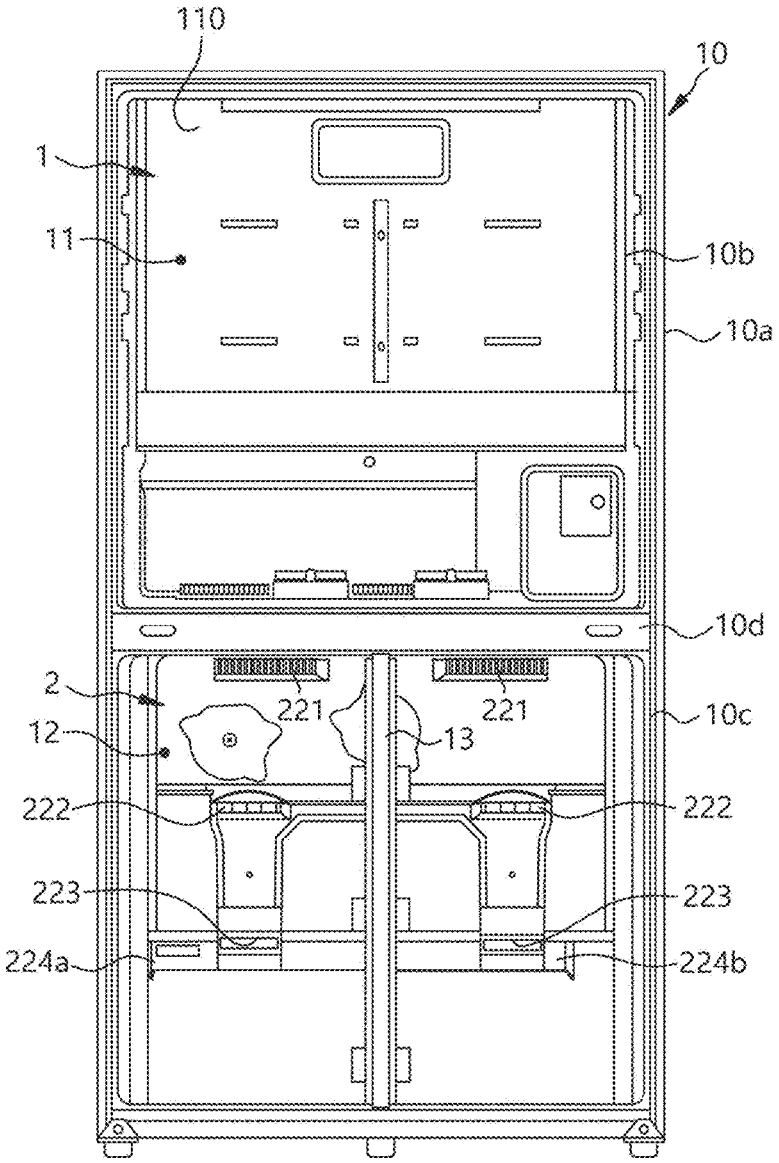
FIG. 4 is a front sectional view showing the internal structure of the refrigerator according to the embodiment of the present disclosure in a state in which two refrigerating compartment doors and two freezing compartment doors are omitted.
Figure 5:
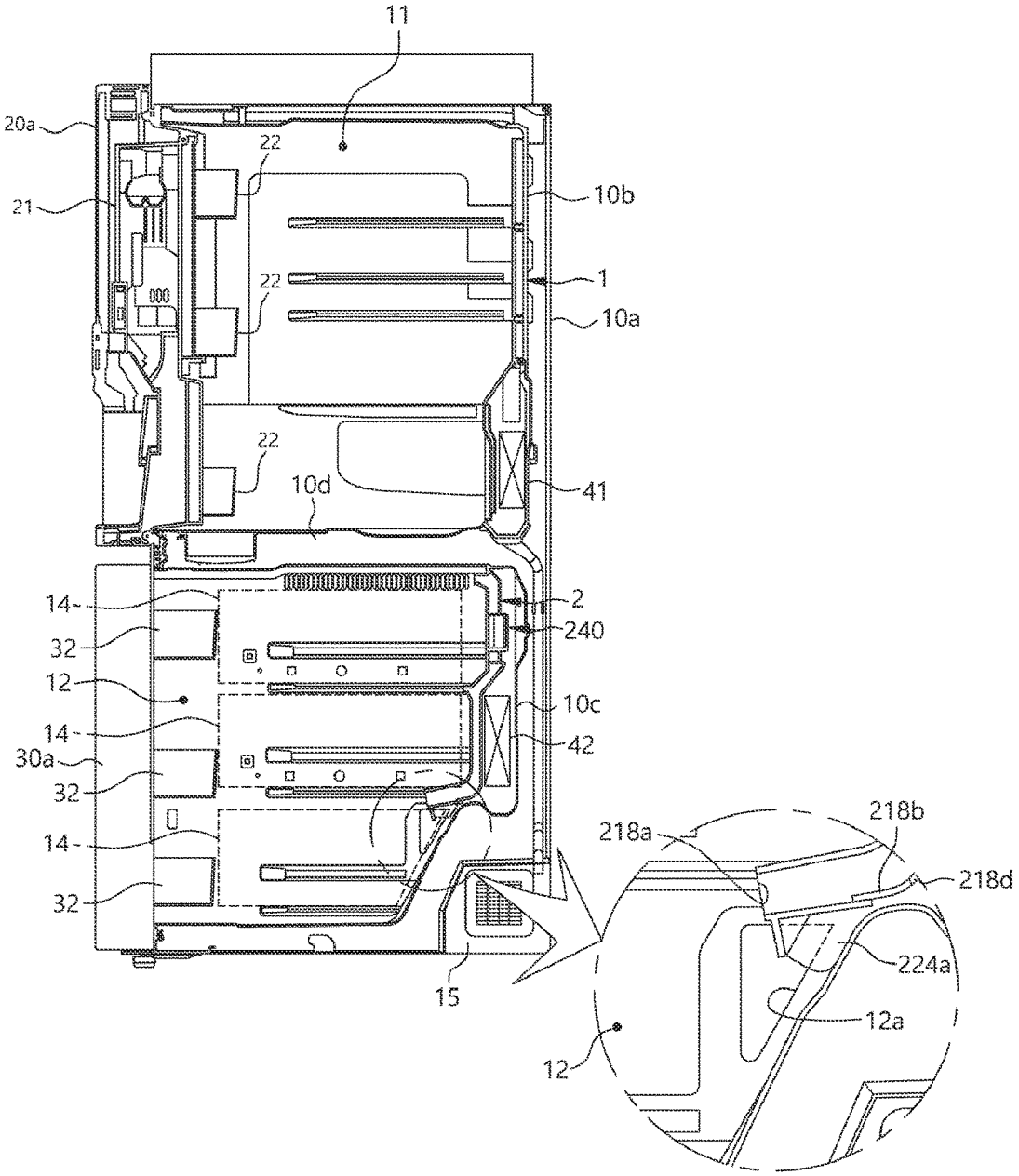
FIG. 5 is a side sectional view showing the internal structure of the refrigerator according to the embodiment of the present disclosure.

FIG. 3 is a front view schematically showing an internal structure of the refrigerator according to the embodiment of the present disclosure. FIG. 4 is a front sectional view showing the internal structure of the refrigerator according to the embodiment of the present disclosure in a state in which two refrigerating compartment doors and two freezing compartment doors are omitted. FIG. 5 is a side sectional view showing the internal structure of the refrigerator according to the embodiment of the present disclosure.

As shown in the drawings, the refrigerator according to the embodiment of the present disclosure includes a refrigerating compartment 11, a freezing compartment 12, and an ice-making compartment 21. The ice-making compartment 21 is configured to be located in any one refrigerating compartment door 20*a* and to receive cool air from a freezing compartment side grille fan assembly 2 with the freezing compartment 12. The freezing compartment side grille fan assembly 2 is configured such that a cool air flow path 214 for the freezing compartment and a cool air flow path 213 for the ice-making compartment are integrally formed and share the cool air with each other through a shared flow path 215*a*, 215*b* (referring to FIG. 16).

The refrigerator according to the embodiment of the present disclosure will be described in detail as follows.

The refrigerating compartment 11 is a storage compartment provided to refrigerate a stored item, and the freezing compartment 12 is a storage compartment provided to freeze a stored item.

The refrigerating compartment 11 is provided in an upper space in a cabinet 10, and the freezing compartment 12 is provided in a lower space in the cabinet 10.

The cabinet 10 may consist of an outer casing 10*a* providing an external surface of the refrigerator and two inner casings 10*b* and 10*c* providing an inner surface of the refrigerator.

Among the two inner casings 10*b* and 10*c*, an upper inner casing 10*b* (Hereinbelow, upper inner casing refers to "inner casing for refrigerating compartment") is a portion providing the refrigerating compartment 11, and a lower inner casing 10*c* (Hereinbelow, lower inner casing refers to "inner casing for freezing compartment") is a portion providing the freezing compartment 12.

That is, an inside space of the inner casing 10*b* for the refrigerating compartment is used as the refrigerating compartment 11, and an inside space of the inner casing 10*c* for the freezing compartment is used as the freezing compartment 12.

Each of the inner casing 10*b* for the refrigerating compartment and the inner casing 10*c* for the freezing compartment is formed in a box shape with an open front surface, and is formed to be spaced apart from each other.

A partition wall 10*d* (referring to FIGS. 4 and 5) may be provided in a space between the two inner casings 10*b* and 10*c*. The partition wall 10*d* may be a separate frame placed between the two inner casings 10*b* and 10*c*, may be a filling material filling between the two inner casings 10*b* and 10*c*, or may be configured as a void.

Furthermore, the refrigerating compartment 11 is configured to be opened and closed by a refrigerating compartment door 20*a*, 20*b*, and the freezing compartment 12 is configured to be opened and closed by a freezing compartment door 30*a*, 30*b*.

The refrigerating compartment door 20*a*, 20*b* is configured as two doors, and configured as double-door type rotary doors (a door installed to be horizontally rotatable) that may respectively open and close opposite portions in the refrigerating compartment 11. The freezing compartment door 30*a*, 30*b* may be configured as two doors, and configured as double-door type rotary doors (a door installed to be horizontally rotatable) that may respectively open and close opposite portions in the freezing compartment 12.

In particular, the ice-making compartment 21 is provided at an inside (a side located in the refrigerating compartment when the refrigerating compartment door is closed) of either refrigerating compartment door 20*a* (Hereinbelow, the door refers to a "first refrigerating compartment door") of the two refrigerating compartment doors 20*a* and 20*b*. The ice-making compartment 21 is a storage compartment having an ice tray (not shown) for making ice in a refrigerating compartment door 20*a*. The ice-making compartment 21 is configured to have a space partitioned from the refrigerating compartment 11. Here the first refrigerating compartment door 20*a* is a refrigerating compartment door located on the left side when the refrigerator is viewed from the front.

Although not shown in the drawings, an ice-making compartment 21 may be additionally provided in another refrigerating compartment door 20*b* (a refrigerating compartment door is located on the right side when the refrigerator is viewed from the front. Hereinbelow, the refrigerating compartment door refers to "second refrigerating compartment door") of the refrigerating compartment doors 20*a* and 20*b*. The ice-making compartment 21 may be configured to be provided in only the second refrigerating compartment door 20*b*.

Meanwhile, a storage box 22 for a stored item may be provided on an inside wall surface (a wall surface exposed to the inside of the refrigerating compartment) of each of the first refrigerating compartment door 20*a* and the second refrigerating compartment door 20*b*.

Further, the freezing compartment 12 is configured to have seating portions for an upper compartment, a middle compartment, and a lower compartment.

In addition, a separation wall 13 is provided in the freezing compartment 12. The separation wall 13 is a wall built for dividing the freezing compartment 12 into left and right spaces, and is configured to vertically cross a center portion in the freezing compartment 12.

The left and right spaces in the freezing compartment 12 divided by the separation wall 13 respectively have the seating portions of the upper, middle, and lower compartments. In each of the seating portions of the upper, middle, and lower compartments, a drawer box 14 14 may be provided to store the stored item.

The drawer box 14 may be installed to be ejected and retracted in a drawer manner. The drawer box 14 in each of the compartments may be configured such that an upper end of the drawer box 14 is spaced apart from a lower surface of another drawer box 14 that is located on an upper side thereof. That is, through a gap between the drawer boxes 14, cool air may pass between the drawer boxes 14.

The two freezing compartment doors 30*a* and 30*b* are configured to open and close the opposite portions in the freezing compartment 12 divided by the separation wall 13, respectively. That is, one freezing compartment door 30*a* (Hereinbelow, the door refers to "first freezing compartment door") is configured to open and close a space of one side in the freezing compartment (the left side space viewed from the front). Further, another freezing compartment door 30*b* (Hereinbelow, the door refers to "second freezing compartment door") is configured to open and close a space of another side in the freezing compartment (the right space viewed from the front).

In addition, a storage box 32 for a stored item may be provided on an inside wall surface of the freezing compartment door 30*a*, 30*b*. The storage box 32 may be a box having an open upper portion.

In addition, evaporators 41 and 42 are provided in front of rear wall surfaces (wall surfaces at the rear of the two inner casings) in the cabinet 10, respectively.

The evaporators 41 and 42 include a first evaporator 41 (an evaporator at refrigerating compartment side) for controlling the inner temperature of the refrigerating compartment 11, and a second evaporator 42 (an evaporator at freezing compartment side) for controlling the inner temperature of the freezing compartment 12. The first evaporator 41 is located at the rear in the inner casing 10*b* for the refrigerating compartment (at the rear in the refrigerating compartment), and the second evaporator 42 is located at the rear in the inner casing 10*c* for the freezing compartment (at the rear in the freezing compartment).

In addition, the two evaporators 41 and 42 are configured to be selectively supplied with a coolant from one compressor (not shown).

The compressor may be provided in a machine chamber 15 in the cabinet 10 with a condenser (not shown). The machine chamber 15 may be provided in a lower rear portion outside the inner casing 10*c* for the freezing compartment. That is, a freezing space of the freezing compartment 12 may be reduced by a size of the machine chamber 15.

The grille fan assemblies 1 and 2 may be provided at the front of the evaporators 41 and 42.

The grille fan assemblies 1 and 2 may include a refrigerating compartment side grille fan assembly 1 provided in the refrigerating compartment 11, and the freezing compartment side grille fan assembly 2 provided in the freezing compartment 12.

Further, a cool air duct 51 for the ice-making compartment may be provided in a gap between the outer casing 10*a* and any one side walls of the two inner casings 10*b* and 10*c* constituting the cabinet 10.

The cool air duct 51 for the ice-making compartment may be a duct that guides cool air supplied from the freezing compartment side grille fan assembly 2 to be supplied to the ice-making compartment 21.

Figure 6:
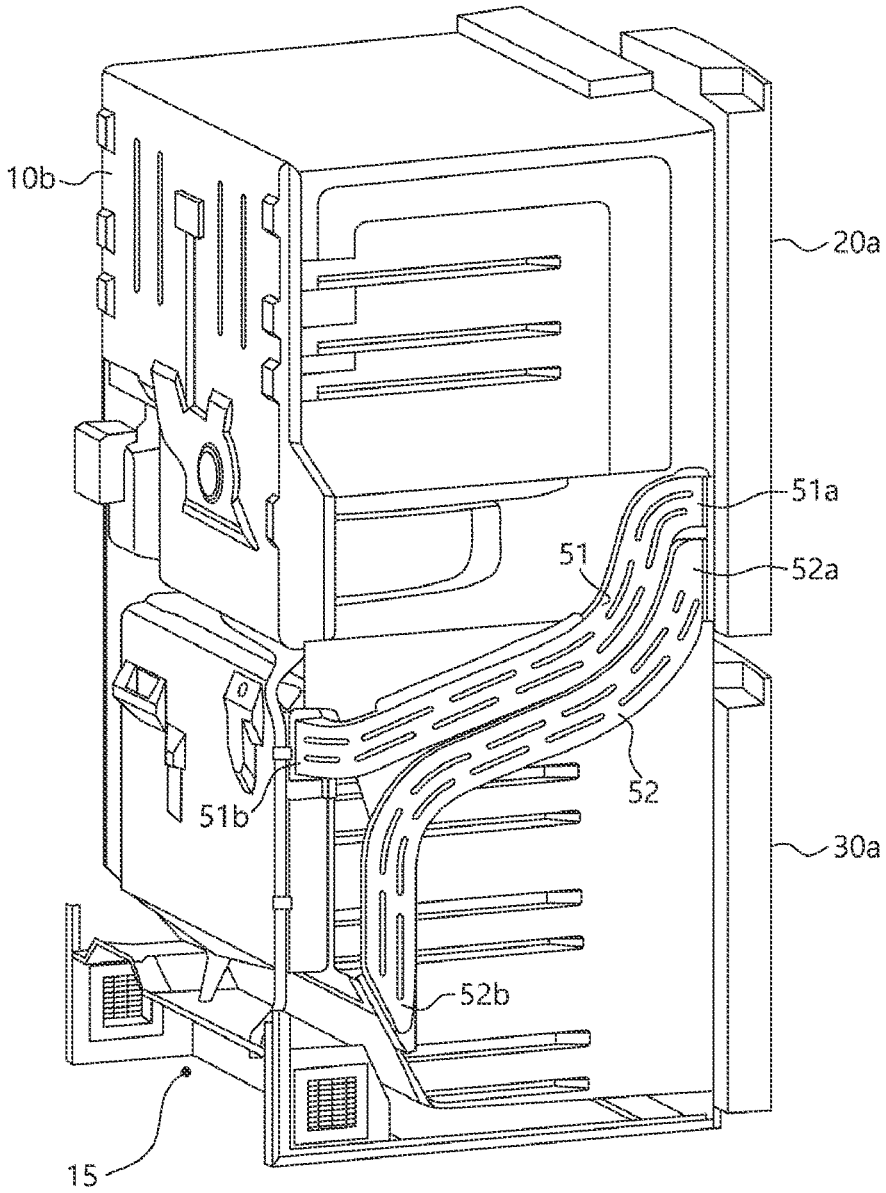
FIG. 6 is a perspective view showing an installation structure of a cool air duct for the ice-making compartment and a recovery duct for the ice-making compartment of the refrigerator according to the embodiment of the present disclosure in a state in which an outer casing of the refrigerator is omitted.
Figure 7:
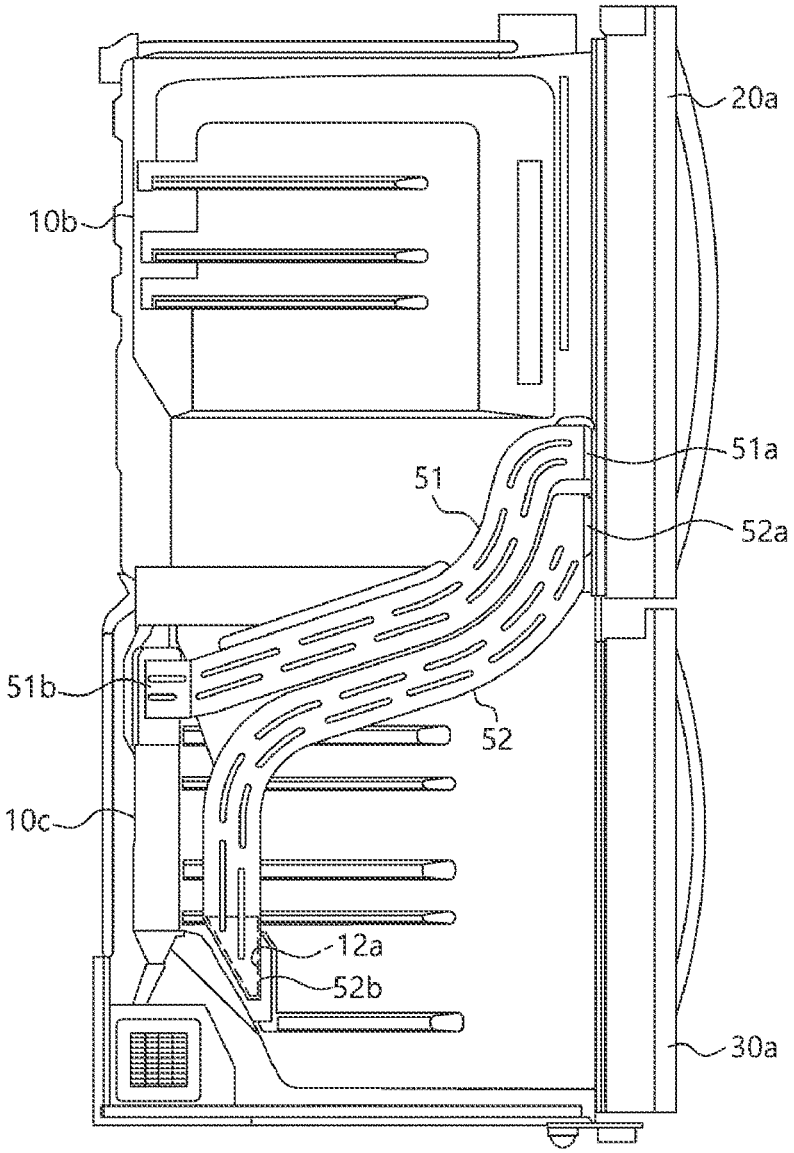
FIG. 7 is a side view showing the installation structure of the cool air duct for the ice-making compartment and the recovery duct for the ice-making compartment of the refrigerator according to the embodiment of the present disclosure in a state in which the outer casing of the refrigerator is omitted.

A first end 51*b* of the cool air duct 51 for the ice-making compartment may be installed by penetrating any one side surface (a side where the refrigerating compartment door with the ice-making compartment is located, the left side in the drawing when viewed from the front) of the freezing compartment side grille fan assembly 2. That is, an outlet through which cool air of the cool air flow path 213 for the ice-making compartment is discharged is configured to be open toward any one side portion between a grille panel 220 and a shroud 210 constituting the freezing compartment side grille fan assembly 2. Accordingly, the cool air blown by an ice-making fan 241 may flow efficiently without sudden change of direction. The above structure is as shown in FIGS. 6 and 7.

The cool air duct 51 for the ice-making compartment is installed along any one side portion in the cabinet 10. In addition, the cool air duct 51 for the ice-making compartment is installed such that a second end 51*a* thereof is exposed to the inside of the refrigerating compartment 11 by penetrating a side wall of the inner casing 10*b* for the refrigerating compartment.

When closing operation of the first refrigerating compartment door 20*a* having the ice-making compartment 21 is performed, the second end 51*a* of the cool air duct 51 for the ice-making compartment is configured to supply the cool air to a supply guide duct 21*a* while matching with the supply guide duct 21*a* provided in the first refrigerating compartment door 20*a*. The supply guide duct 21*a* is formed to extend to the ice-making compartment 21 and is configured to supply the cool air to the ice-making compartment 21.

Figure 8:
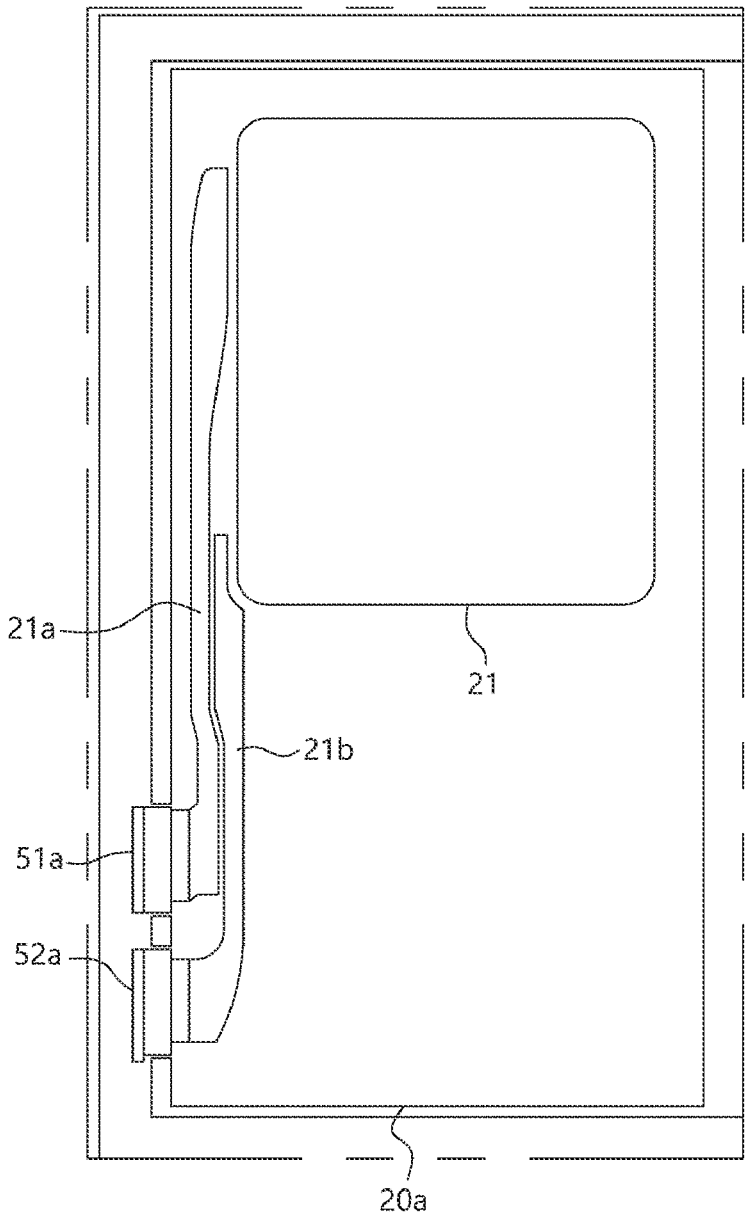
FIG. 8 is a view schematically showing a flow path structure for cool air supply and recovery to/from the ice-making compartment of the refrigerator according to the embodiment of the present disclosure.
Figure 9:
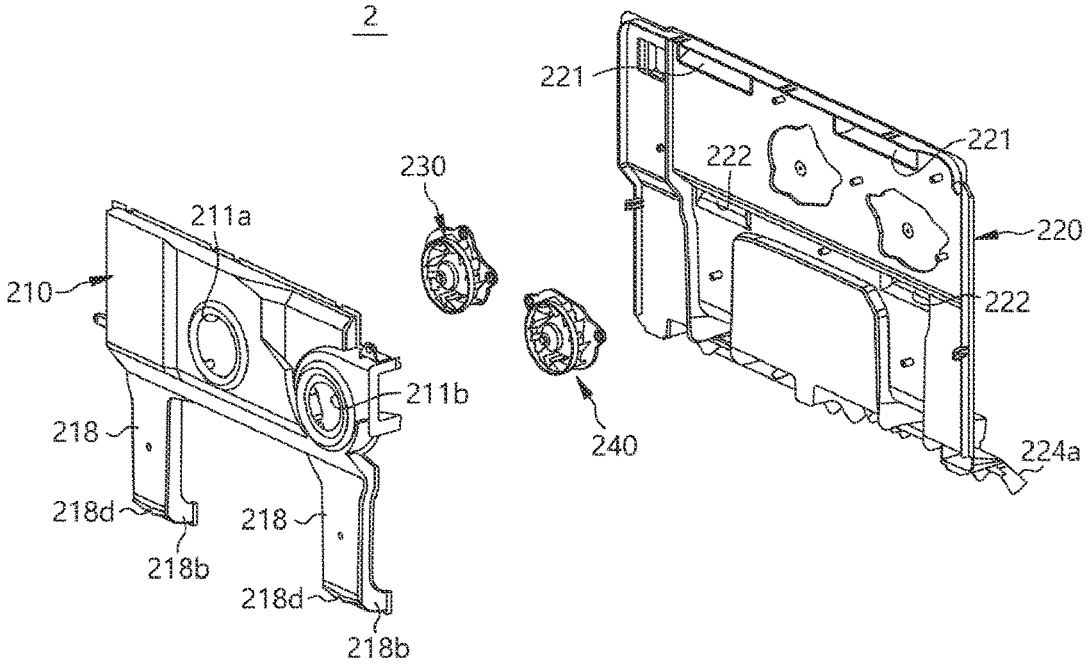
FIG. 9 is a disassembled perspective view showing a freezing compartment side grille fan assembly of the refrigerator according to the embodiment of the present disclosure.
Figure 10:
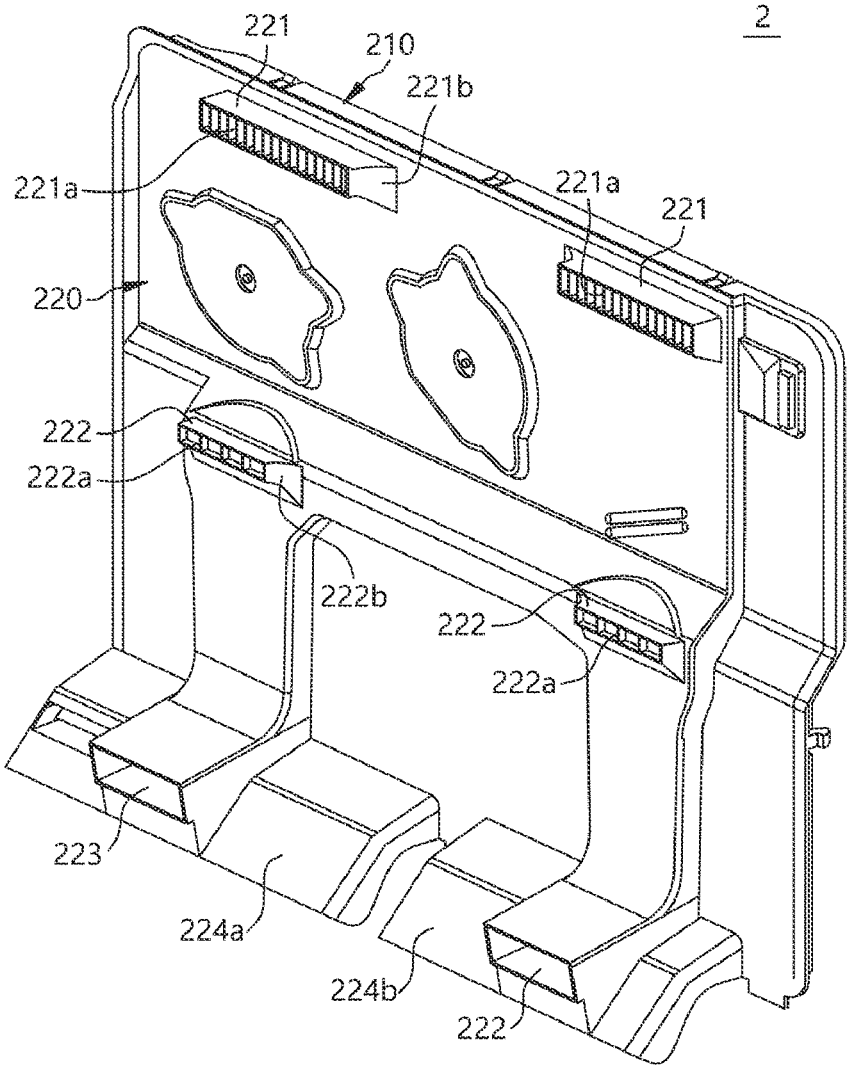
FIG. 10 is a front assembled perspective view showing the freezing compartment side grille fan assembly of the refrigerator according to the embodiment of the present disclosure.
Figure 11:
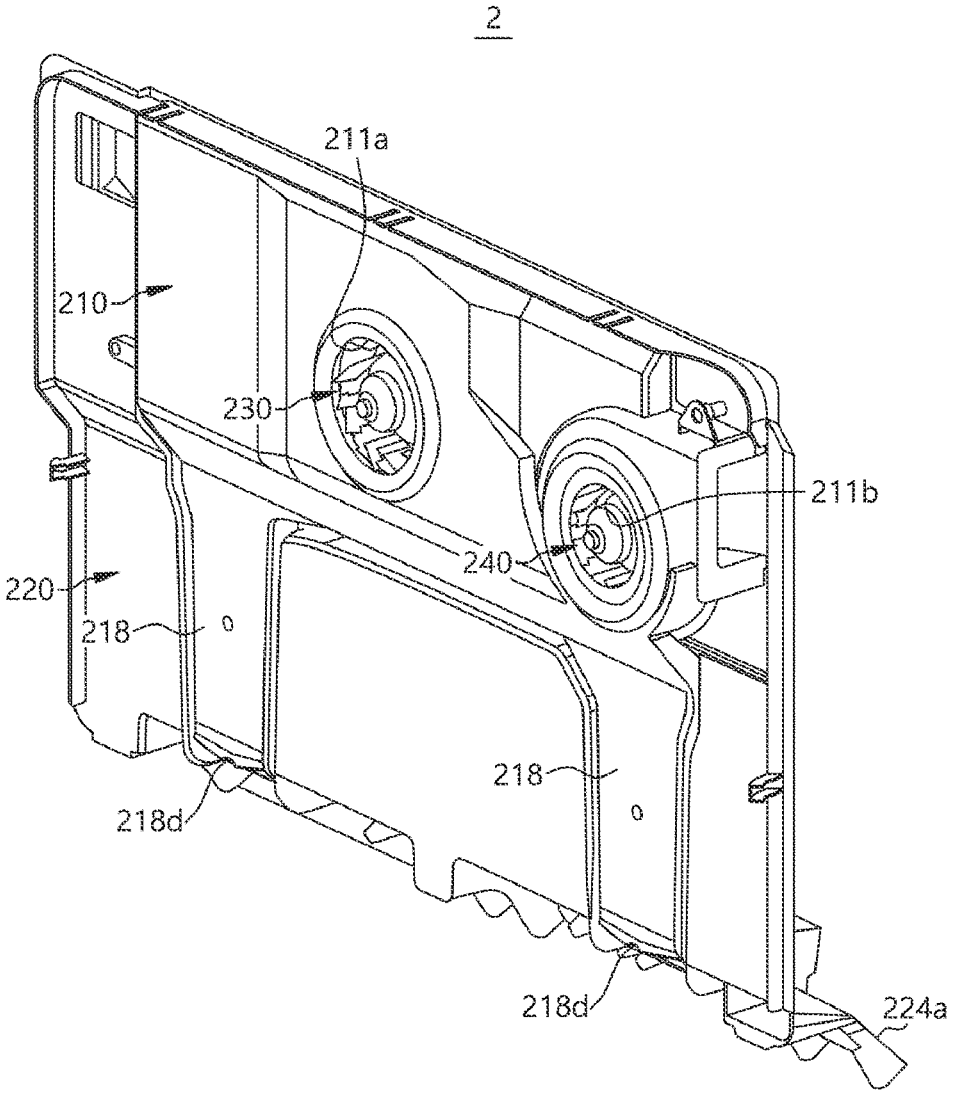
FIG. 11 is a rear assembled perspective view showing the freezing compartment side grille fan assembly of the refrigerator according to the embodiment of the present disclosure.
Figure 12:
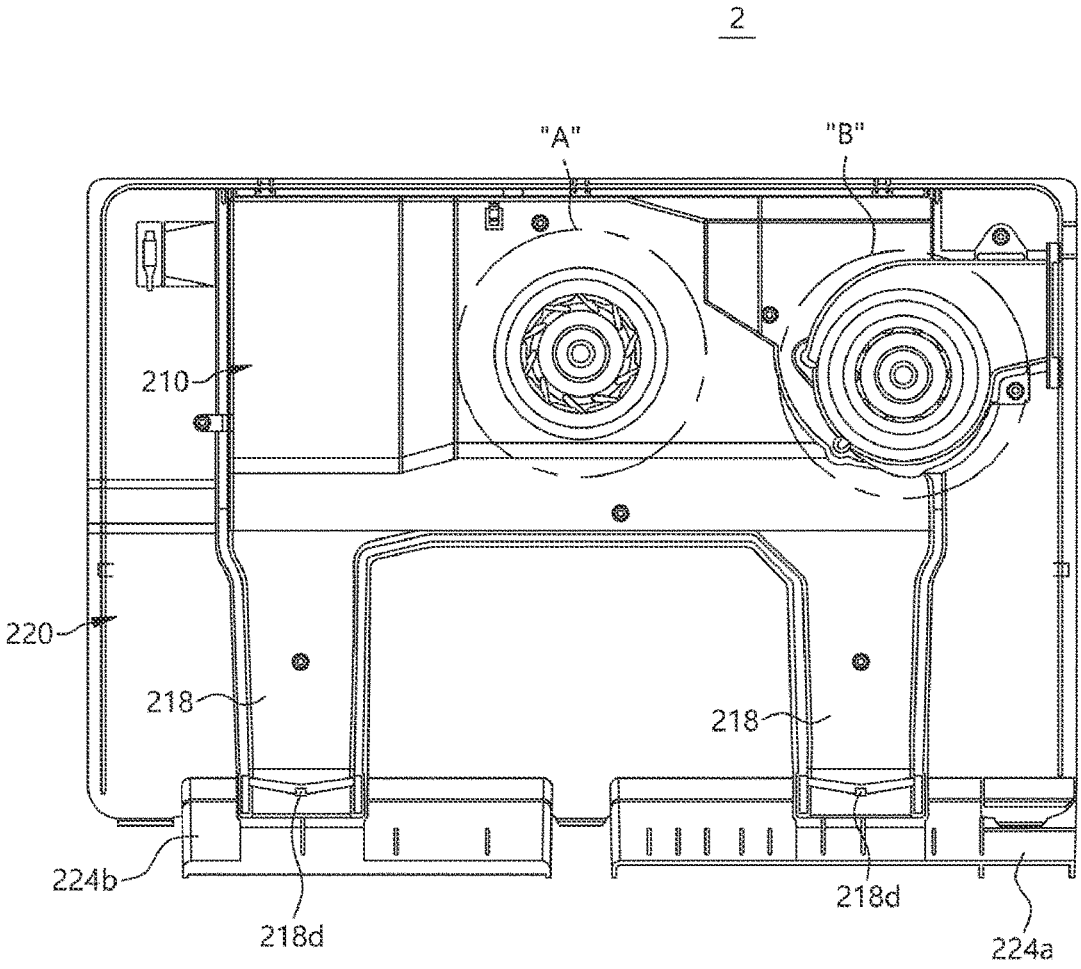
FIG. 12 is a rear view showing the freezing compartment side grille fan assembly of the refrigerator according to the embodiment of the present disclosure.

In addition, a recovery guide duct 21*b* is provided in the first refrigerating compartment door 20*a*. A first end of the recovery guide duct 21*b* is connected to the ice-making compartment 21 and a second end thereof is formed to extend to a lower portion of a side wall of the first refrigerating compartment door 20*a*, thereby guiding a recovery flow of the cool air passing through the ice-making compartment 21. The above structure is as shown in FIG. 8.

Further, a recovery duct 52 for the ice-making compartment is provided in a gap between the outer casing 10*a* and any one side wall of the inner casing 10*b*, 10*c* of the cabinet 10.

The recovery duct 52 for the ice-making compartment is a duct for guiding the cool air passing through the ice-making compartment 21 to be recovered to the freezing compartment 12.

The recovery duct 52 for the ice-making compartment is configured such that a first end 52*a* thereof is exposed to the inside of the refrigerating compartment 11 by penetrating the side wall of the inner casing 10*b* for the refrigerating compartment. The first end 52*a* of the recovery duct 52 for the ice-making compartment is configured to match with the second end of the recovery guide duct 21*b* when closing operation of the first refrigerating compartment door 20*a* having the ice-making compartment 21 is performed.

In addition, the recovery duct 52 for the ice-making compartment is configured such that a second end 52*b* thereof passes through a penetration hole 12*a* (referring to FIG. 5) provided in a side wall of the inner casing 10*c* for the freezing compartment to be exposed to the inside of the freezing compartment 12.

The second end 52*b* of the recovery duct 52 for the ice-making compartment is configured to be located at the rearmost side of the lower compartment in the freezing compartment 12.

In particular, it is preferable that the penetration hole 12*a* where the second end 52*b* of the recovery duct 52 for the ice-making compartment is located is located as close to a cool air suction side (a side where cool air recovered from the freezing compartment to the second evaporator is suctioned) of the freezing compartment side grille fan assembly 2 as possible. That is, the cool air recovered from the recovery duct 52 for the ice-making compartment may flow directly toward the second evaporator 42 without affecting the temperature and humidity in the freezing compartment 12 as little as possible.

Meanwhile, the refrigerator according to the embodiment of the present disclosure includes the improved freezing compartment side grille fan assembly 2.

In the conventional general freezing compartment side grille fan assembly, a cool air flow path for a freezing fan module and a cool air flow path for an ice-making fan module are configured to have separate structures and configured to be coupled to each other. However, in the improved freezing compartment side grille fan assembly 2 according to the embodiment of the present disclosure, a cool air flow path 214 for a freezing fan module 230 and a cool air flow path 213 for an ice-making fan module 240 are formed on any one wall surface of the freezing compartment side grille fan assembly 2. The cool air flow paths 213 and 214 share cool air with each other through the shared flow path 215*a*, and an open portion of a cool air outlet side of the shared flow path 215*a* is formed not to face the freezing fan module 230.

As described above, according to the embodiment of the present disclosure, as the two cool air flow paths 213 and 214 share cool air with each other through the shared flow path 215*a*, the freezing compartment side grille fan assembly 2 of the refrigerator may supply more cool air to the freezing compartment 12. In addition, when only the ice-making fan 241 is operated, the cool air in the freezing compartment 12 may be prevented from flowing backward.

Hereinbelow, the embodiment of a detailed structure of the freezing compartment side grille fan assembly 2 will be described in detail with reference to FIGS. 9 to 25.

The freezing compartment side grille fan assembly 2 includes the shroud 210.

The shroud 210 is a portion constituting a rear wall surface of the freezing compartment side grille fan assembly 2.

The second evaporator 42 is located in the rear of the freezing compartment 12 of a rear wall surface in the cabinet 10 (a rear wall surface in the inner casing). The shroud 210 is located at front of the second evaporator 42.

The shroud 210 has a first inlet hole 211*a* and a second inlet hole 211*b* that are formed by penetrating the shroud 210.

The two inlet holes 211*a* and 211*b* are holes provided to allow the cool air, which is heat-exchanged while passing through the second evaporator 42 located at the rear in the freezing compartment 12, to flow into a gap between the grille panel 220 for the freezing compartment and the shroud 210.

In a front surface of the shroud 210, the freezing fan module 230 is installed in a portion where the first inlet hole 211*a* is formed, and the ice-making fan module 240 is installed in a portion where the second inlet hole 211*b* is formed.

The freezing fan module 230 is located to face the first inlet hole 211*a*, and the ice-making fan module 240 is located to face the second inlet hole 211*b*.

In particular, the first inlet hole 211*a* is located at a center portion between the upper compartment and the middle compartment constituting the freezing compartment 12. The second inlet hole 211*b* is located at either side of the first inlet hole 211*a*. That is, the freezing fan module 230 is located at the center portion between the upper compartment and the middle compartment constituting the freezing compartment 12 in each portion of the freezing compartment side grille fan assembly 2, and the ice-making fan module 240 is located at either side of the freezing fan module 230. Therefore, the cool air blown in a radial direction of the freezing fan 231 by the operation of the freezing fan module 230 may be efficiently supplied to all of the upper, middle, and lower compartments in the freezing compartment. Further, the cool air blown in a radial direction of the ice-making fan 241 by the operation of the ice-making fan module 240 may be forcibly supplied toward the side of the freezing compartment side grille fan assembly 2 while having directionality.

The first inlet hole 211*a* is designed in consideration of the flow amount of cool air supplied to the freezing compartment 12 through the freezing fan module 230. The second inlet hole 211*b* is designed in consideration of the pressure of cool air supplied to the ice-making compartment 21 through the ice-making fan module 240.

That is, since the freezing fan module 230 supplies the cool air to the freezing compartment 12 located at front of the freezing fan module 230, the freezing fan module 230 should be configured to supply a sufficient amount of cool air. On the other hand, since the ice-making fan module 240 supplies the cool air to the ice-making compartment 21 located in the first refrigerating compartment door 20*a*, the ice-making fan module 240 should be configured to supply a sufficient amount of cool air over a long distance.

Of course, as in the conventional general technique, the freezing fan module 230 may use a type of fan for high air volume, and the ice-making fan module 240 may use a type of fan having excellent pressure-feeding power.

However, when the freezing fan module 230 and the ice-making fan module 240 use different types of fans, the communalization and standardization of the fan cannot be realized. In this case, there is a problem in that a type of each fan should be determined according to the required air volume or pressure-feeding distance, and a flow path should be changed according to the determined fan type.

In the embodiment of the present disclosure, in order to solve the above problem, the freezing fan module 230 and the ice-making fan module 240 are configured to use the same type of fan to realize the communalization and standardization of the fan.

In particular, in order to use the same type of fan for the freezing fan module 230 and the ice-making fan module 240, the first inlet hole 211*a* may be formed relatively larger than the second inlet hole 211*b*, so that the first inlet hole 211*a* may have a low pressure-feeding force, but may discharge a lot of cool air. The second inlet hole 211*b* may be formed relatively smaller than the first inlet hole 211*a*, so that second inlet hole 211*b* may have a small discharge amount of cool air, but have a high pressure-feeding force enough to supply cool air to the ice-making compartment 21. The above structures are shown in FIGS. 13 and 14.

Figure 13:
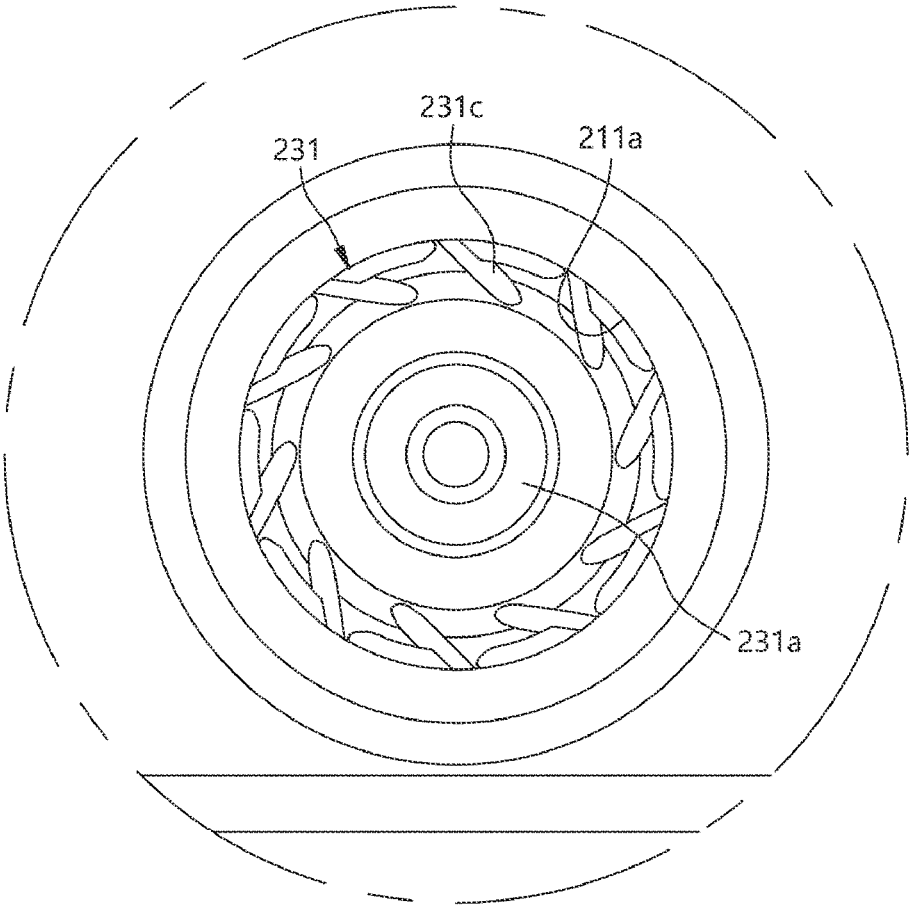
FIG. 13 is an enlarged view showing part "A" in FIG. 12.
Figure 14:
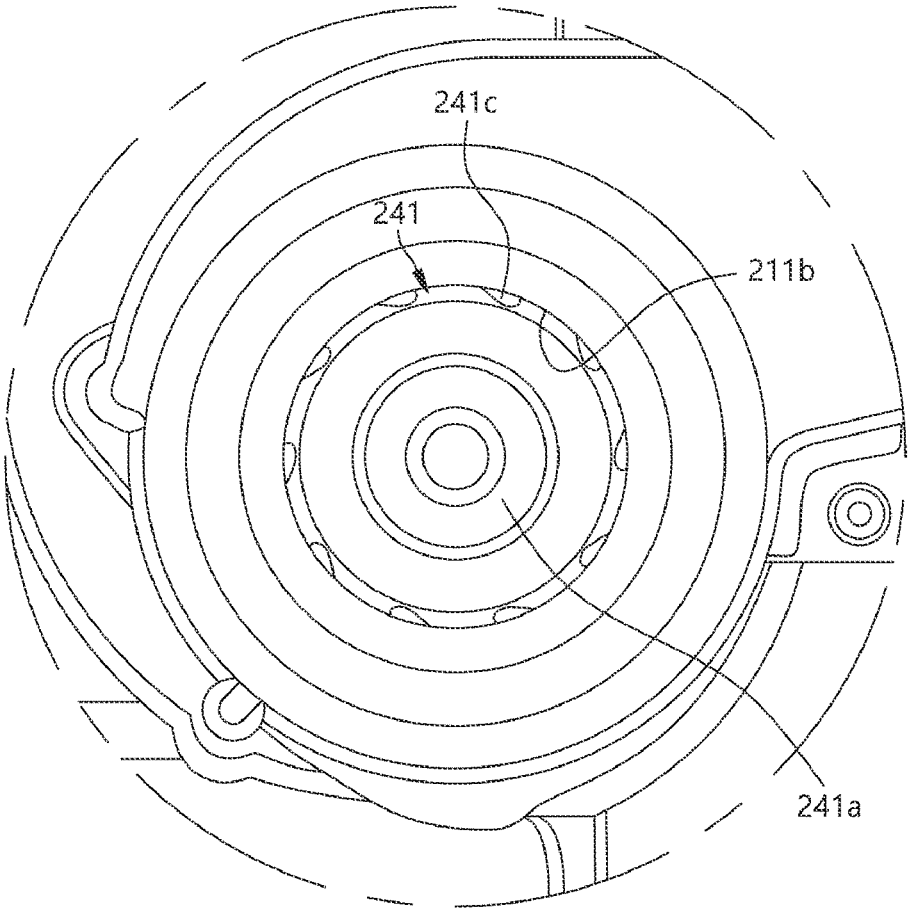
FIG. 14 is an enlarged view showing part "B" in FIG. 12.

Herein, the first inlet hole 211*a* is formed to have an inner diameter enough to expose at least a half of each impeller 231*c* of the freezing fan 231 constituting the freezing fan module 230 (referring to FIG. 13).

That is, the above structure may allow the impeller 231*c* to guide the cool air passing through the first inlet hole 211*a* and supplied to a gap between impellers 231*c* to be directly discharged in the radial direction of the freezing fan 231.

Preferably, the first inlet hole 211*a* may be formed to have the inner diameter enough to expose a great portion of each impeller 231*c* of the freezing fan 231.

On the other hand, the second inlet hole 211*b* may be formed to have an inner diameter that does not expose a great portion of each impeller 241*c* of the ice-making fan 241 (referring to FIG. 14).

That is, when each impeller 241*c* of the ice-making fan 241 is further exposed through the second inlet hole 211*b*, the reverse flow, that is, cool air passes through the second inlet hole 211*b* in a reverse direction while being discharged in a rotational direction of the ice-making fan 241 is frequently generated. In this case, a cool air flow reversely passing through the second inlet hole 211*b* and a cool air flow passing through the second evaporator 42 and flowing into the second inlet hole 211*b* collide with each other, so that a pressure-feeding force of cool air facing the cool air flow path 213 for the ice-making compartment is relatively lowered.

The second inlet hole 211*b* may be formed to have a size to expose only up to half of each impeller 241*c*, thereby increasing the pressure feeding force.

Preferably, the second inlet hole 211*b* is formed to have the size such that each impeller 241*c* is not exposed. That is, a great portion of an open portion between impellers 241*c* is covered so that the reverse flow of cool air can be fundamentally prevented.

In addition, the cool air flow path 213 for the ice-making compartment and the cool air flow path 214 for the freezing compartment are respectively formed at the front surface of the shroud 210.

The cool air flow path 213 for the ice-making compartment is a flow path that guides the cool air passing through the second inlet hole 211*b* and flowing into a gap between the shroud 210 and the grille panel 220 to flow into a connection portion to the cool air duct 51 for the ice-making compartment. The cool air flow path 214 for the freezing compartment is a flow path that guides the cool air blown by the freezing fan 231 to each of the upper, middle, and lower compartments, of the freezing compartment 12.

The cool air flow path 214 for the freezing compartment is formed by recessing the front surface of the shroud 210. The cool air flow path 213 for the ice-making compartment is formed in either side of the cool air flow path 214 for the freezing compartment in the front surface of the shroud 210.

Figure 15:
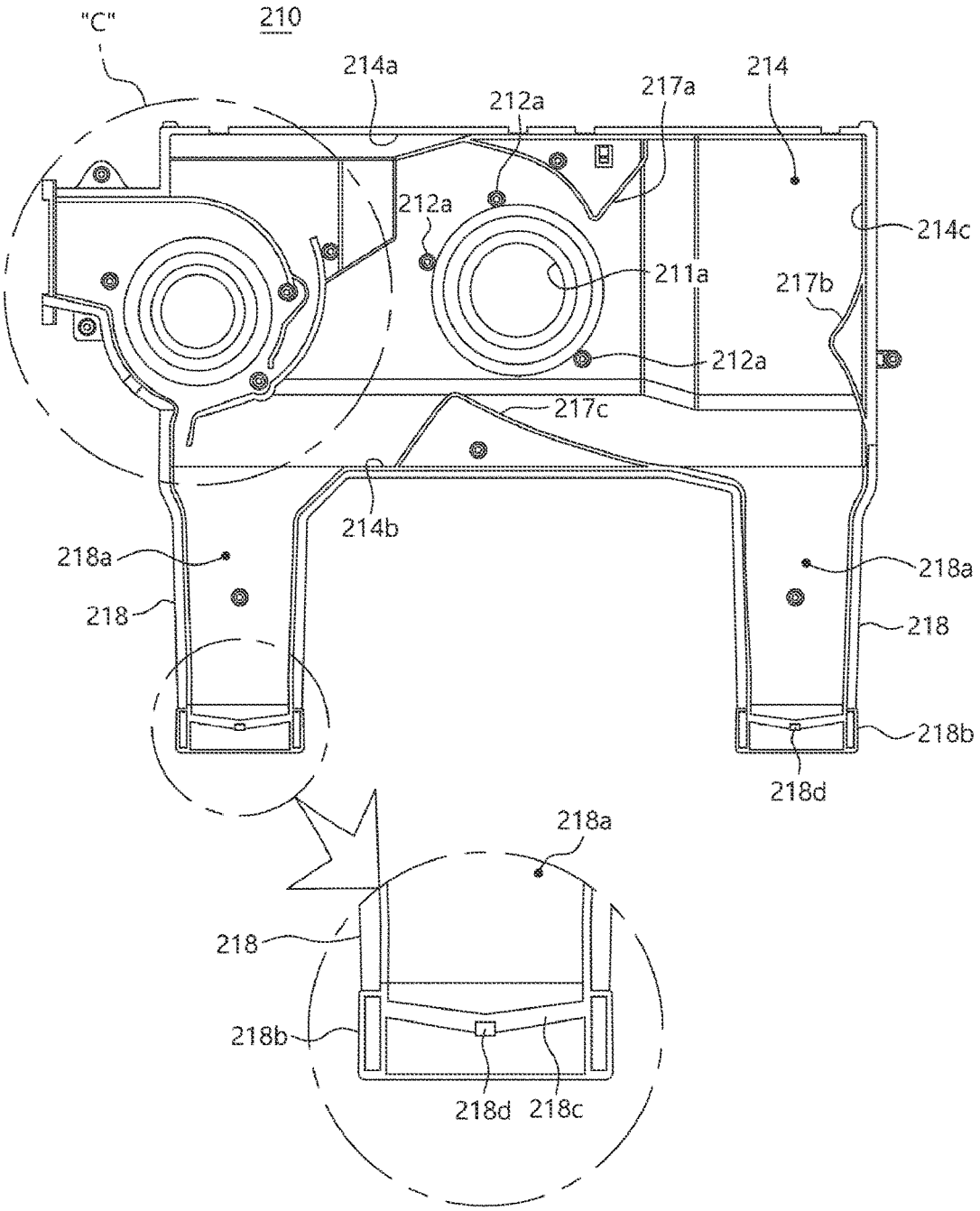
FIG. 15 is a front view showing a shroud of the freezing compartment side grille fan assembly of the refrigerator according to the embodiment of the present disclosure.

Outer edge portions of the front surface of the shroud 210 constitute inner wall surfaces of the cool air flow path 214 for the freezing compartment. That is, the cool air flow path 214 for the freezing compartment is formed to have an upper wall surface 214*a* located at the upper side on the basis of the first inlet hole 211*a*, a lower wall surface 214*b* located at the lower side on the basis of the first inlet hole 211*a*, a first side wall surface 214*c* at the side where the cool air flow path 213 for the ice-making compartment is located, and a second side wall surface 214*d* facing the first side wall surface 214*c*, as shown in FIGS. 15 and 16.

Figure 16:
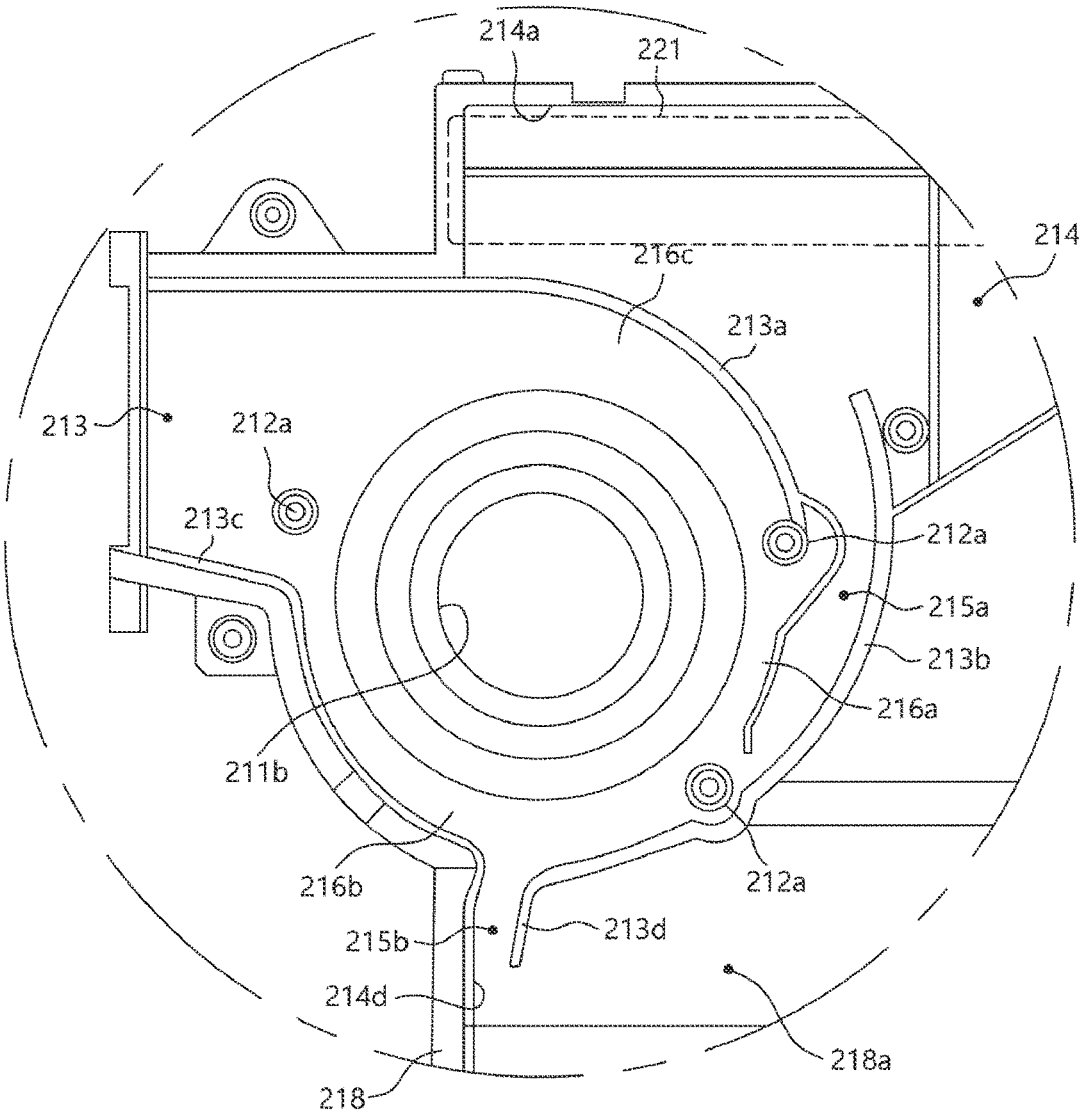
FIG. 16 is an enlarged view showing part "C" in FIG. 15.
Figure 17:
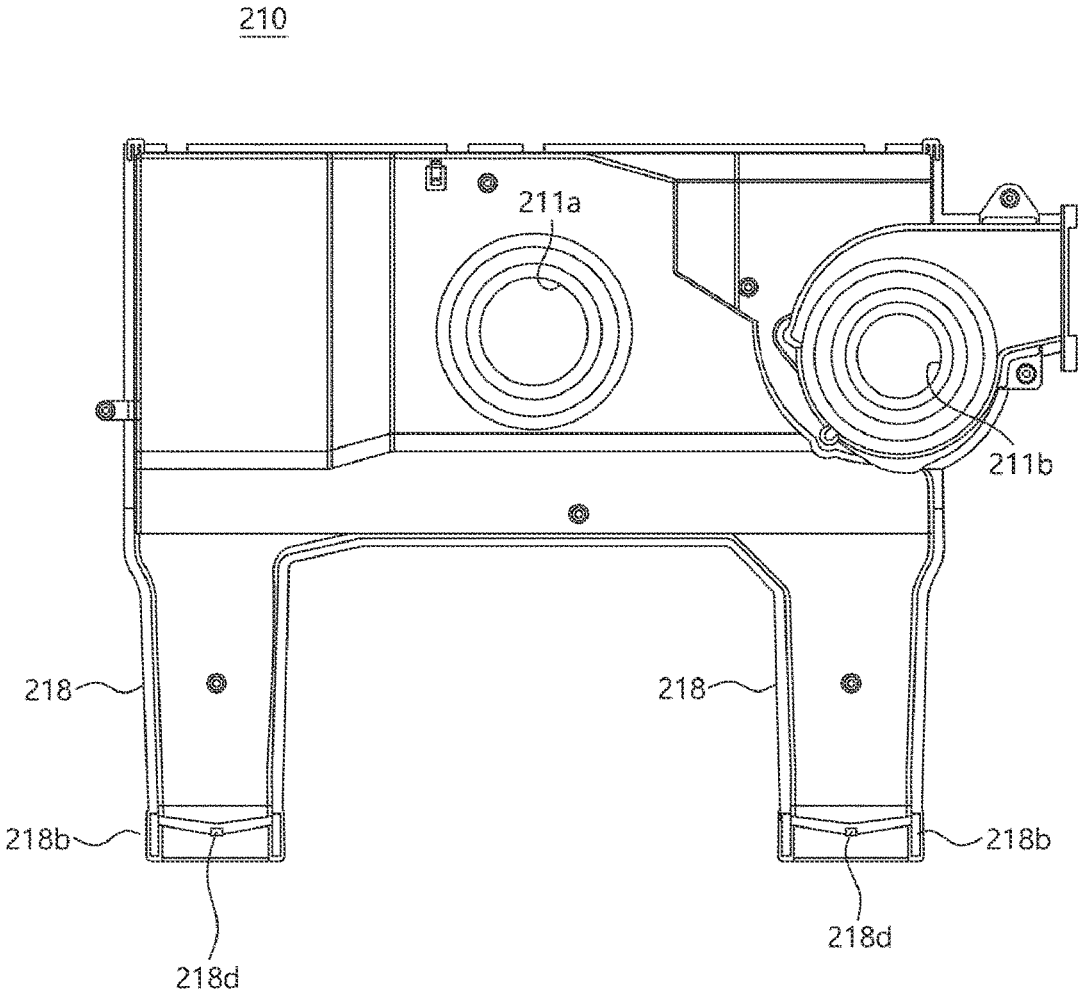
FIG. 17 is a rear view showing the shroud of the freezing compartment side grille fan assembly of the refrigerator according to the embodiment of the present disclosure.

In particular, the cool air flow path 214 for the freezing compartment and the cool air flow path 213 for the ice-making compartment are formed to be separated from each other by flow path rib 213*a*, 213*b* (shown in FIG. 16). That is, the cool air flow path 213 for the ice-making compartment separated from the cool air flow path 214 for the freezing compartment by the flow path rib 213*a*, 213*b* is provided on the front surface of the shroud 210.

The flow path rib 213*a*, 213*b* protrudes from the front surface of the shroud 210 and provides a circumferential wall surface of the cool air flow path 213 for the ice-making compartment. That is, the cool air introduced through the second inlet hole 211*b* is guided to the connection portion to the cool air duct 51 for the ice-making compartment by flowing along the cool air flow path 213 for the ice-making compartment provided by the flow path rib 213*a*, 213*b*.

The flow path rib 213*a*, 213*b* includes a first circumferential flow path rib 213*a* and a second circumferential flow path rib 213*b* that are formed along a circumference of the second inlet hole 211*b*. The portion where the second inlet hole 211*b* is provided may be partitioned from the cool air flow path 214 for the freezing compartment by the two circumferential flow path ribs 213*a* and 213*b*. The cool air passing through the second inlet hole 211*b* may be blown along the cool air flow path 213 for the ice-making compartment provided by the flow path rib 213*a*, 213*b* into the cool air duct 51 for the ice-making compartment.

The first circumferential flow path rib 213*a* is configured to cross between the first inlet hole 211*a* and the second inlet hole 211*b* in the front surface of the shroud 210. That is, as the first circumferential flow path rib 213*a* is configured to block between the ice-making fan module 240 and the freezing fan module 230, the cool air provided from the freezing fan module 230 is prevented from being directly discharged through a cool air outlet of the cool air flow path 213 for the ice-making compartment.

In addition, the first circumferential flow path rib 213*a* is rounded to surround a part of a circumference at one side (a side of the freezing fan module is located) of the ice-making fan module 240. Accordingly, the cool air blown in the radial direction of the ice-making fan 241 by the operation of the ice-making fan 241 may flow in a circumferential direction of the ice-making fan 241 by guidance of the first circumferential flow path rib 213*a*, and the cool air may flow toward the communication portion with the cool air duct 51 for the ice-making compartment.

The second circumferential flow path rib 213*b* is configured to surround a lower circumference of a portion where the ice-making fan module 240 is installed, in the front surface of the shroud 210. That is, the second circumferential flow path rib 213*b* divides the lower portion of the ice-making fan module 240 from the center portion between the ice-making fan module 240 and the freezing fan module 230.

In addition, the second circumferential flow path rib 213*b* is rounded to surround the lower circumference of the ice-making fan module 240.

The flow path rib 213*a*, 213*b* has the shared flow path 215*a*, 215*b*.

The shared flow path 215*a*, 215*b* includes an upper shared flow path 215*a*.

That is, the upper shared flow path 215*a* allows the cool air in the cool air flow path 213 for the ice-making compartment blown by the ice-making fan module 240 to be partially supplied into the cool air flow path 214 for the freezing compartment.

In particular, when the freezing fan 231 and the ice-making fan 241 are operated at the same time, the upper shared flow path 215*a* is configured such that a part of the cool air blown by the ice-making fan 241 is additionally supplied into the freezing compartment 12 through the upper shared flow path 215*a*. Therefore, the amount of cool air supplied to the freezing compartment 12 may be increased due to the additional supply of cool air, and rapid control of the temperature in the freezing compartment 12 may be performed.

When the freezing fan 231 is not operated and only the ice-making fan 241 is operated, the pressure at the side of the second inlet hole 211*b* where the ice-making fan 241 is located is relatively lower than the pressure at the side of the first inlet hole 211*a*. Therefore, there is a concern that the cool air in the freezing compartment 12 passes through the cool air flow path 214 for the freezing compartment and flows through the first inlet hole 211*a* into the portion where the second evaporator 42 is located. Then the cool air is suctioned through the second inlet hole 211*b* into the cool air flow path 213 for the ice-making compartment.

However, as the upper shared flow path 215*a* is provided, even when only the ice-making fan 241 is operated, the pressure difference between the two flow paths 213 and 214 is reduced by cool air sharing between the cool air flow path 214 for the freezing compartment and the cool air flow path 213 for the ice-making compartment. Accordingly, the cool air in the freezing compartment 12 is prevented from flowing backward into the cool air flow path 213 for the ice-making compartment.

In addition, the first circumferential flow path rib 213*a* is formed to be spaced apart from the second circumferential flow path rib 213*b*. That is, the upper shared flow path 215*a* through which the cool air flows is provided as the first circumferential flow path rib 213*a* and the second circumferential flow path rib 213*b* are spaced apart from each other.

In particular, an upper end of the second circumferential flow path rib 213*b* is formed to surround an outer circumferential surface of a lower end of the first circumferential flow path rib 213*a*. That is, due to the structure of the two circumferential flow path ribs 213*a* and 213*b*, the upper shared flow path 215*a* is formed to face an upper surface of either side (the upper surface of the side where the cool air flow path for the ice-making compartment is provided and the side where a cool air outlet for the upper compartment is provided) in the cool air flow path 214 for the freezing compartment. The above structure is as shown in FIG. 16.

The cool air outlet 221 for the upper compartment is located in a portion facing the upper shared flow path 215*a*. A part of the cool air flowing in the cool air flow path 213 for the ice-making compartment is supplied to an upper portion of the cool air flow path 214 for the freezing compartment through the cool air outlet 221 for the upper compartment. Then, the cool air may be supplied to the upper compartment in the freezing compartment 12 through the cool air outlet 221 for the upper compartment.

That is, even when the cool air passing through the upper shared flow path 215*a* is supplied to the cool air flow path 214 for the freezing compartment, the cool air is directly discharged to the freezing compartment 12 through the cool air outlet 221 for the upper compartment. Accordingly, the flow of the cool air flowing in the cool air flow path 214 for the freezing compartment is not affected.

In particular, the open portion at the cool air outlet side of the upper shared flow path 215*a* is formed not to face the freezing fan module 230 located in the first inlet hole 211*a*.

That is, the discharge direction of the cool air provided from the upper shared flow path 215*a* and the direction of the cool air blown by the freezing fan module 230 are not equal to each other. Therefore, flow interference between two cool air flows may be prevented.

Therefore, the upper end of the second circumferential flow path rib 213*b* is configured to be located higher than the first inlet hole 211*a* (referring to FIG. 15). That is, the cool air flowing in the circumferential direction of the freezing fan 231 by the rotation of the freezing fan 231 is prevented from being directly blown toward the open portion at the cool air outlet side of the upper shared flow path 215*a*.

However, when the upper end of the second circumferential flow path rib 213*b* is located lower than the first inlet hole 211*a*, while the cool air blowing from the freezing fan 231 is provided into the upper shared flow path 215*a* between the first circumferential flow path rib 213*a* and the second circumferential flow path rib 213*b*, interference between the cool air blown from the freezing fan 231 and the cool air discharged from the upper shared flow path 215*a* may occur. Therefore, the upper end of the second circumferential flow path rib 213*b* is configured to be located higher than the first inlet hole 211*a*, so that collision between the cool air discharged from the upper shared flow path 215*a* and the cool air blown by the freezing fan 231 may be prevented (or minimized).

In addition, the upper end of the second circumferential flow path rib 213*b* is configured to be gradually spaced apart from the lower end of the first circumferential flow path rib 213*a* as the second circumferential flow path rib 213*b* goes upward.

That is, the upper shared flow path 215*a* is configured to be gradually increased as the upper shared flow path 215*a* goes from a cool air inlet side (the side communicating with the cool air flow path for the ice-making compartment) to the cool air outlet side (the side communicating with the cool air flow path for the freezing compartment).

The discharge flow rate of the cool air supplied to the cool air flow path 214 for the freezing compartment through the upper shared flow path 215*a* may be reduced. Accordingly, the flow of the cool air flowing along the cool air flow path 214 for the freezing compartment by the operation of the freezing fan module 230 does not interfere (or the interference between the two air flows is minimized).

In addition, the shroud 210 may have a straight line side flow path rib 213*c*.

The straight line side flow path rib 213*c* is formed from a lower end of the second circumferential flow path rib 213*b* (the end opposite to the side where the first circumferential flow path rib is located) and penetrates the first side wall surface 214*c* of the shroud 210 to protrude outward.

That is, the cool air flow path 213 for the ice-making compartment has a predetermined length flow path by the straight line side flow path rib 213*c* and the protruding structure thereof. Accordingly, the cool air flowing in the circumferential direction along the two circumferential flow path ribs 213*a* and 213*b* may be forcibly supplied with the straightness to the cool air duct 51 for the ice-making compartment connected to the freezing compartment side grille fan assembly 2.

The straight line side flow path rib 213*c* may be formed by bending (recessing or protruding) an edge portion of the shroud 210. The straight line side flow path rib 213*c* may be formed in a rib protruding from a surface of the shroud 210, such as the two circumferential flow path ribs 213*a* and 213*b*, as described above.

In addition, the shroud 210 has an extension part 218.

The extension part 218 is a portion that extends downward from a lower surface of each side of the shroud 210 to the lower compartment of the freezing compartment 12.

In particular, an extension flow path 218*a* communicating with the cool air flow path 214 for the freezing compartment is provided at a front surface of the extension part 218, so that a part of the cool air flowing in the cool air flow path 214 for the freezing compartment is guided toward the portion where the lower compartment of the freezing compartment 12 is located.

The extension flow path 218*a* (or the extension part) is formed to extend downward from each of two facing portions of a cool air outlet 222 for the middle compartment in the cool air flow path 214 for the freezing compartment to each of two facing portions of a cool air outlet 223 for the lower compartment.

That is, the cool air flow path 214 for the freezing compartment formed in the shroud 210 guides the supply of cool air with respect to the upper and middle compartments of the freezing compartment 12. The extension flow path 218*a* guides a part of the cool air flowing in the cool air flow path 214 for the freezing compartment to be supplied to the lower compartment of the freezing compartment 12.

Further, the shared flow path 215*a*, 215*b* formed in the shroud 210 may include a lower shared flow path 215*b*.

The lower shared flow path 215*b* is a flow path provided to guide the supply of the cool air to a lower surface in the cool air flow path 214 for the freezing compartment. When only the ice-making fan 241 is operated, the lower shared flow path 215*b* supplies the cool air to the freezing compartment 12 to reduce the pressure difference between the cool air flow path 214 for the freezing compartment (or freezing compartment) and the cool air flow path 213 for the ice-making compartment.

The lower shared flow path 215*b* may be formed by spacing the lower end of the second circumferential flow path rib 213*b* apart from a side wall surface 214*c* at the side where the cool air flow path 213 for the ice-making compartment is provided, in the opposite side wall surfaces 214*c* and 214*d* of the cool air flow path 214 for the freezing compartment.

That is, as the lower shared flow path 215*b* is formed on a wall surface in the extension flow path 218*a*, when the cool air is supplied into the cool air flow path 214 for the freezing compartment 214 (or the extension flow path) by passing through the lower shared flow path 215*b*, the cool air may affect the cool air flowing from the cool air flow path 214 for the freezing compartment to the extension flow path 218*a*.

In particular, the lower end 213*d* (referring to FIG. 16) of the second circumferential flow path rib 213*b* is formed by being bent in a direction parallel to a direction of the first side wall surface 214*c* at the side where the cool air flow path 213 for the ice-making compartment is provided, in the opposite side wall surfaces of the cool air flow path 214 for the freezing compartment. That is, as the lower shared flow path 215*b* is formed to have a predetermined length, the cool air passing through the lower shared flow path 215*b* may flow along wall surfaces of the first side wall surface 214*c* and the extension flow path 218*a*.

The lower end 213*d* of the second circumferential flow path rib 213*b* may be formed parallel to the first side wall surface 214*c*. Alternately, as the second circumferential flow path rib 213*b* goes downward, the lower end 213*d* of the second circumferential flow path rib 213*b* may be formed to be gradually adjacent to the first side wall surface 214*c*.

Although not shown in the drawings, the lower shared flow path 215*b* may be formed in a separate flow path penetrating the second circumferential flow path rib 213*b*.

In addition, a bent end 218*b* bent forward is provided on a lower end of the extension part 218, and a drainage hole 218*d* is formed by penetrating an edge portion (border portion) connecting the bent end 218*b* to the extension part 218.

That is, the inside of the cool air flow path 213 for the ice-making compartment is configured to communicate with the refrigerating compartment 11 through the cool air duct 51 for the ice-making compartment. Because of the above structure, condensed water may be generated in the cool air duct 51 for the ice-making compartment due to the temperature difference with the outside air. In addition, the condensed water may flow backward to the cool air flow path 213 for the ice-making compartment while flowing along the cool air duct 51 for the ice-making compartment.

Considering the above structure, the refrigerator is configured such that, the condensed water flowing backward to the cool air flow path 213 for the ice-making compartment flows into the extension flow path 218*a* through the lower shared flow path 215*b* provided in the second circumferential flow path rib 213*b*. Then, the condensed water is discharged to the outside of the freezing compartment side grille fan assembly 2 through the drainage hole 218*d*.

On an inside surface of the bent end 218*b*, a drainage groove 218*c* may be formed by being depressed so that the condensed water flowing through the extension flow path 218*a* may be collected and discharged toward the drainage hole 218*d*. The drainage hole 218*d* may be formed at the center of the drainage groove 218*c*, and the drainage groove 218*c* may be formed to be inclined (or rounded) downward as the drainage groove 218*c* goes to the center thereof. The structure thereof will be described in detail with reference to FIGS. 15, 22, and 23.

Figure 20:
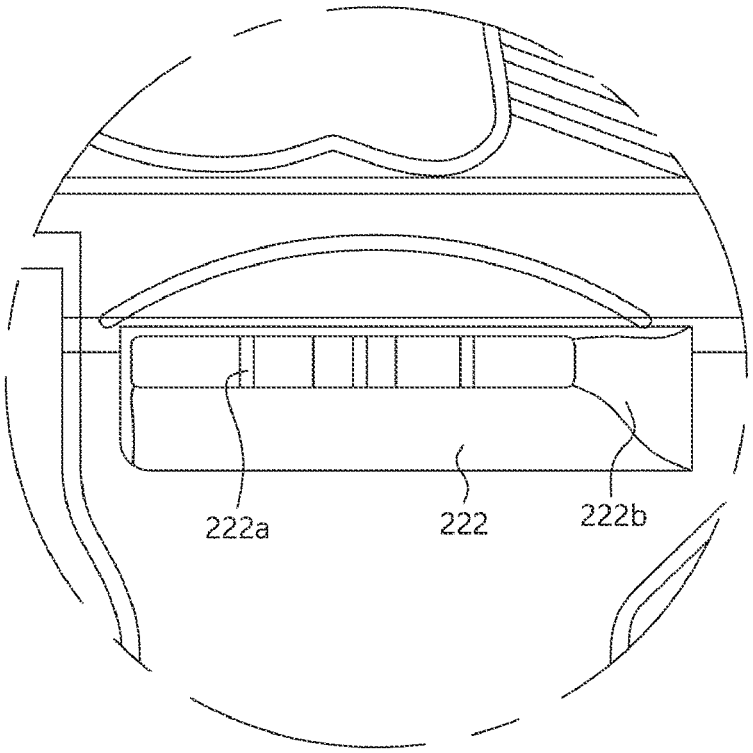
FIG. 20 is an enlarged view showing part "E" in FIG. 18.
Figure 21:
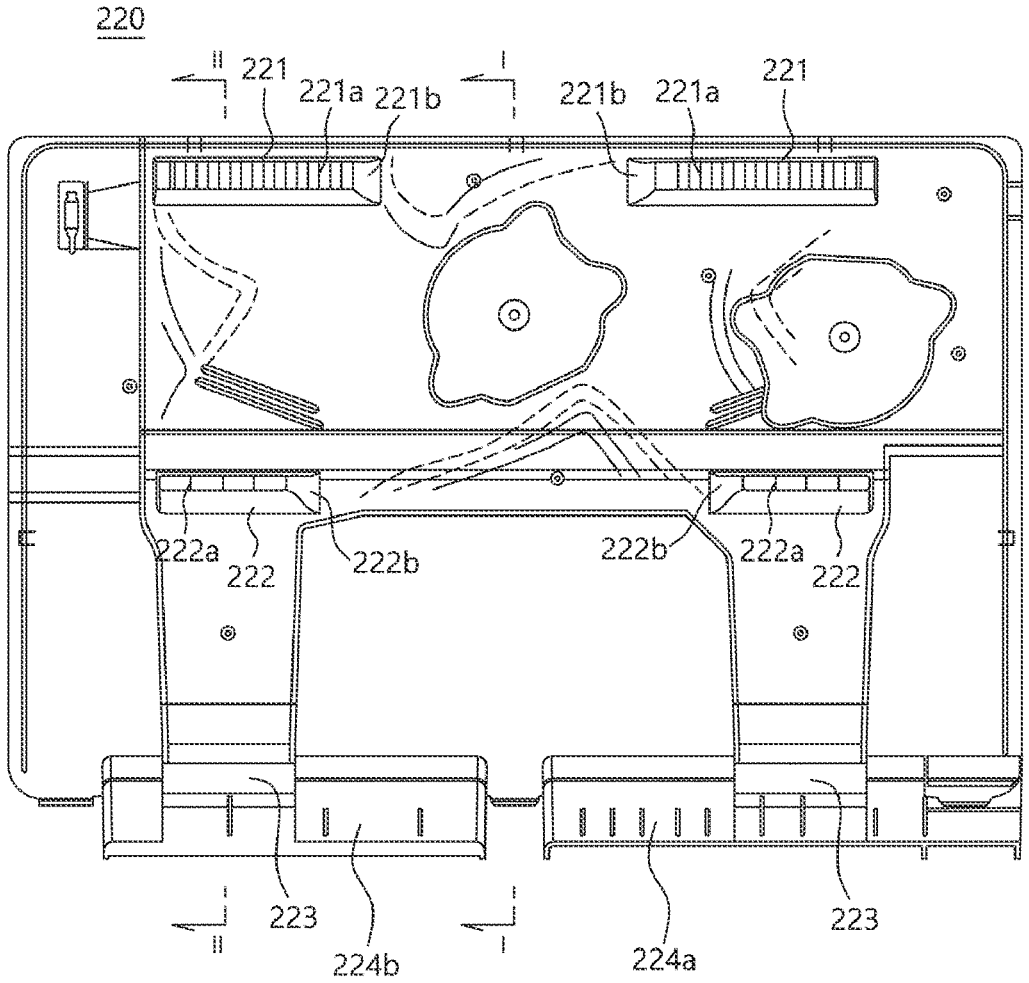
FIG. 21 is a rear view showing the grille fan of the freezing compartment side grille fan assembly of the refrigerator according to the embodiment of the present disclosure.
Figure 22:
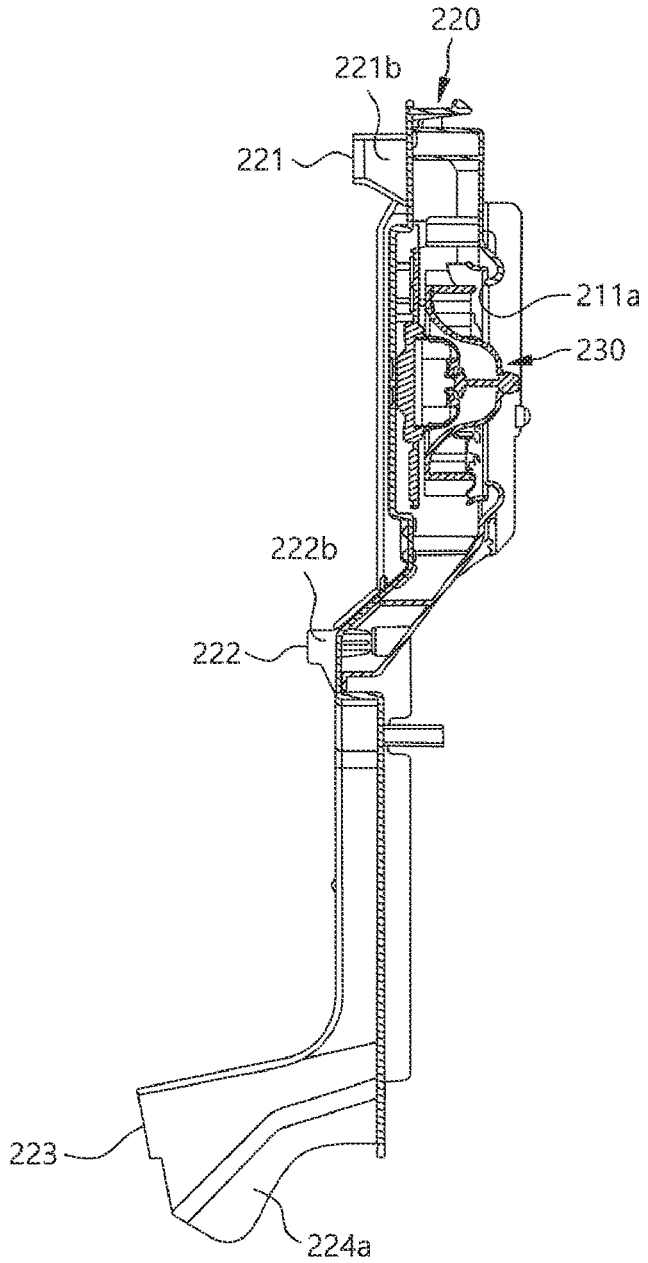
FIG. 22 is a sectional view taken along line I-I in FIG. 21.
Figure 23:
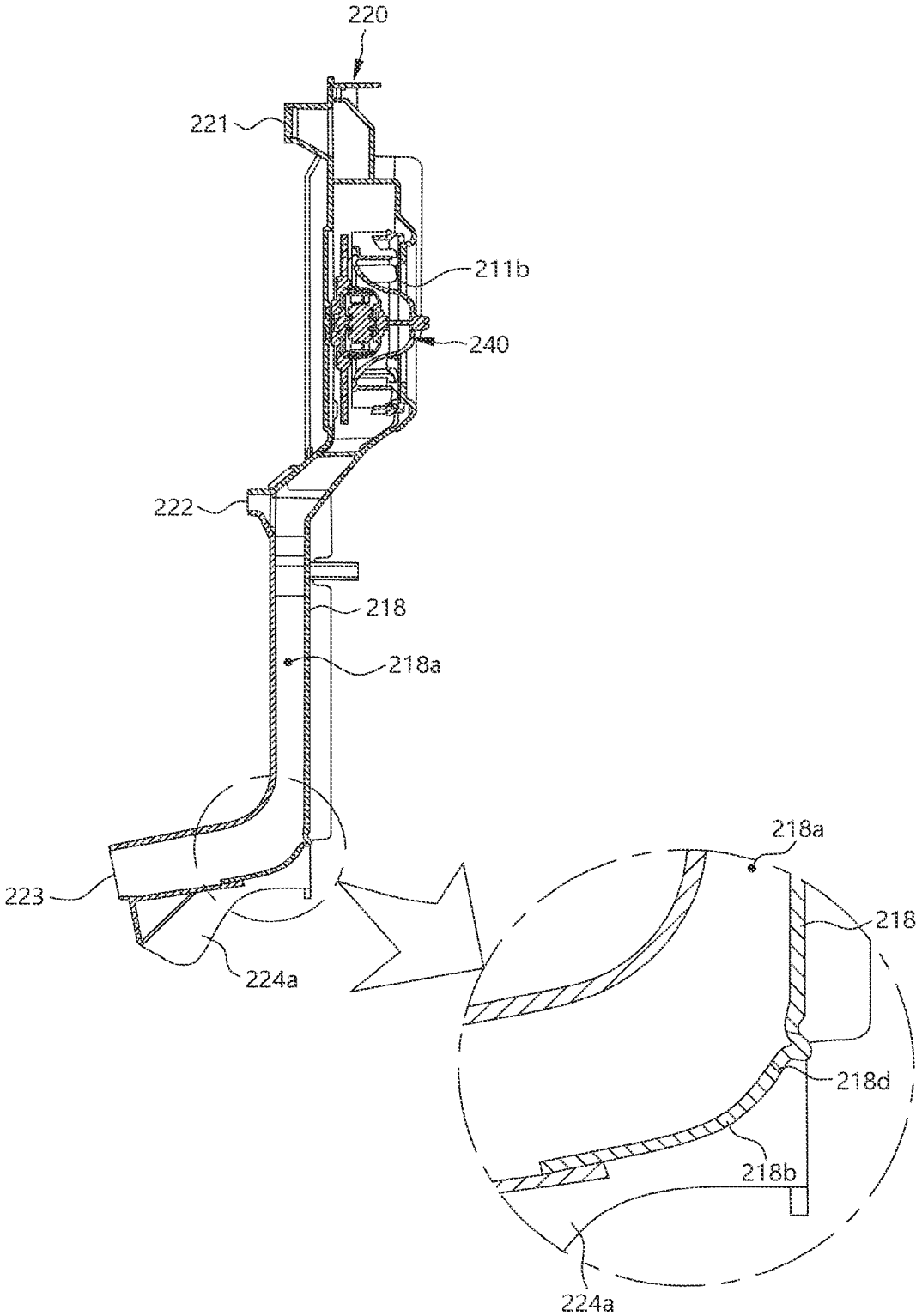
FIG. 23 is a sectional view taken along line in FIG. 21.

Meanwhile, a cool air inlet side portion (a circumferential portion of the first inlet hole) of the cool air flow path 213 for the ice-making compartment may be divided into a plurality of areas 216*a*, 216*b*, and 216*c* for inflow of cool air (referring to FIG. 20).

That is, the cool air flow path 213 for the ice-making compartment is configured as three areas as follow. A first area 216*a* is commonly located between the first circumferential flow path rib 213*a* and the ice-making fan module 240 and between the second circumferential flow path rib 213*b* and the ice-making fan module 240. A second area 216*b* is located between a lower surface of the ice-making fan module 240 and the second circumferential flow path rib 213*b*. A third area 216*c* is located between an upper surface of the ice-making fan module 240 and the first circumferential flow path rib 213*a* and communicates with the side at the cool air outlet of the cool air flow path 213 for the ice-making compartment.

In particular, the first area 216*a* communicates with the upper shared flow path 215*a*, the second area 216*b* communicates with the lower shared flow path 215*b*, and the third area 216*c* communicates with the cool air outlet side of the cool air flow path 213 for the ice-making compartment.

In addition, the third area 216*c* is configured to supply the amount of cool air that is approximately equal to the sum of the supply amounts of cool air of the first area 216*a* and the second area 216*b*. The second area 216*b* is configured to supply a relatively larger amount of cool air than the first area 216*a*. That is, approximately half of the entire cool air blown by the operation of the ice-making fan 241 is supplied to the ice-making compartment 21 through the third area 216*c*, and the other half is supplied to the cool air flow path 214 for the freezing compartment through the first area 216*a* and the second area 216*b*.

The cool air supplied to the first area 216*a* is discharged toward an upper space in the cool air flow path 214 for the freezing compartment through the upper shared flow path 215*a*. The cool air supplied to the second area 216*b* is discharged toward the lower space (the extension flow path) in the cool air flow path 214 for the freezing compartment through the lower shared flow path 215*b*.

In addition, each of the above-described flow path ribs 213*a*, 213*b*, and 213*c* is in close contact with a rear surface the grille panel 220, which will be described below, thereby closing the cool air flow path 213 for the ice-making compartment formed by the flow path ribs 213*a*, 213*b*, and 213*c* from the external environment of the freezing compartment side grille fan assembly 2.

Although not shown in the drawings, the cool air flow path 213 for the ice-making compartment may be formed by protruding from the rear surface of the grille panel 220 toward the front surface of the shroud 210.

Furthermore, a plurality of guides 217*a*, 217*b*, and 217*c* is formed on the front surface of the shroud 210.

That is, on the front surface of the shroud 210, the cool air flow path 213 for the ice-making compartment and the cool air flow path 214 for the freezing compartment are separately formed by the flow path ribs 213*a*, 213*b*, and 213*c*. The cool air flow path 214 for the freezing compartment is configured to evenly or selectively supply the cool air to each portion of the shroud 210 (or the grille panel) by the guides 217*a*, 217*b*, and 217*c*.

The guides 217*a*, 217*b*, and 217*c* may include a first guide 217*a* guiding an upper flow of the cool air that passes through the first inlet hole 211*a* of the shroud 210 and flows into the cool air flow path 214 for the freezing compartment.

That is, when the cool air blown by the rotation of the freezing fan 231 in an upper direction of the freezing fan 231 hits the upper wall surface 214*a* of the cool air flow path 214 for the freezing compartment, turbulence of the air flow occurs in the hit portion and the flow of the cool air is not efficiently performed. Considering the above problem, the first guide 217*a* is provided to allow the cool air blown toward the upper wall surface 214*a* of the cool air flow path 214 for the freezing compartment to flow toward both sides of the upper wall surface 214*a*.

The first guide 217*a* may be formed in an inclined or rounded inverted triangular structure that gradually expands to opposite sides thereof, as the first guide 217*a* goes upward from a portion adjacent to the first inlet hole 211*a* to the upper wall surface 214*a* of the cool air flow path 214 for the freezing compartment.

A lower end (lower vertex portion) of the first guide 217*a* is located to deviate toward one side (a side opposite to the side where the cool air flow path for the ice-making compartment is located) front the center of the first inlet hole 211*a*. Therefore, more cool air that is rotatably blown in the circumferential direction of the freezing fan 231 may be supplied to a portion connected to the second end 52*b* of the recovery duct 52 for the ice-making compartment, in the opposite side spaces in the freezing compartment 12.

In particular, it is preferable that the lower end (lower vertex portion) of the first guide 217*a* is formed to be spaced apart from the first inlet hole 211*a* at a predetermined distance. Because of the above structure, when the first guide 217*a* is located excessively close to the first inlet hole 211*a*, a noise from flowing cool air may be severely generated when the ice-making fan 231 is rotated.

Further, the guide 217*a* may include a second guide 217*b* that guides a lower flow of the cool air passing through the first inlet hole 211*a* of the shroud 210 and flowing into the space between the grille panel 220 and the shroud 210.

That is, when the cool air blown by the rotation of the freezing fan 231 in a lower direction of the freezing fan 231 hits the lower wall surface 214*b* of the cool air flow path 214 for the freezing compartment, turbulence of the air flow occurs in the hit portion and the flow of the cool air is not efficiently performed. Considering the above problem, the second guide 217*b* is provided such that the cool air blown toward the lower wall surface 214*b* of the cool air flow path 214 for the freezing compartment may flow efficiently toward the opposite sides of the lower wall surface 214*b*.

The second guide 217*b* may be formed in an inclined or rounded triangular structure that gradually expands to opposite sides thereof, as the second guide 217*b* goes downward from a portion adjacent to the first inlet hole 211*a* to the lower wall surface 214*b* of the cool air flow path 214 for the freezing compartment.

An upper end (upper vertex portion) of the second guide 217*b* is located to deviate toward another side (the side where the cool air flow path for the ice-making compartment is located) from the center of the first inlet hole 211*a*.

Therefore, cool air blown by being rotated in a circumferential direction of the freezing fan 231 may be sufficiently supplied to not only the middle compartment in the freezing compartment 12 but also the lower compartment therein.

In particular, it is preferable that the upper end (upper vertex portion) of the second guide 217*b* is formed to be spaced apart from the first inlet hole 211*a* at a predetermined distance. Because of the above structure, when the second guide 217*b* is located excessively close to the first inlet hole 211*a*, a noise from flowing cool air may be severely generated when the freezing fan 231 is rotated.

Each guide 217*a*, 217*b*, 217*c* may include a third guide 217*c* that guides upper and lower flows of the cool air passing through the first inlet hole 211*a* of the shroud 210 and flowing into the space between the grille panel 220 and the shroud 210.

That is, when the cool air blown toward the second side wall surface 214*d* of the cool air flow path 214 for the freezing compartment by the rotation of the freezing fan 231 hits the second side wall surface 214*d* of the cool air flow path 214 for the freezing compartment, turbulence of air flow occurs in the hit portion and the flow of the cool air is not efficiently performed. Considering the above problem, the third guide 217*c* is provided such that the cool air blown toward the second side wall surface 214*d* of the cool air flow path 214 for the freezing compartment may flow efficiently toward the upper and lower sides of the second side wall surface 214*d*.

The third guide 217*c* may be formed in an inclined or rounded triangular structure that gradually expands upward and downward, as the third guide 217*c* goes from the side portion (the portion opposite to the side where the ice-making fan is located) of the first inlet hole 211*a* to the second side wall surface 214*d* of the cool air flow path 214 for the freezing compartment.

The freezing compartment side grille fan assembly 2 includes the grille panel 220.

The grille panel 220 constitutes a front wall surface of the freezing compartment side grille fan assembly 2, and is located in front of the shroud 210.

Further, the grille panel 220 has a plurality of cool air outlets 221, 222, and 223.

The cool air outlets 221, 222, and 223 include the cool air outlet 221 for the upper compartment for discharging the cool air to the upper compartment of the freezing compartment 12, the cool air outlet 222 for the middle compartment for discharging the cool air to the middle compartment of the freezing compartment 12, and the cool air outlet 223 for the lower compartment for discharging the cool air to the lower compartment of the freezing compartment 12. The cool air outlets are as shown in FIGS. 18 to 21.

In particular, the cool air outlet 221 for the upper compartment is configured as two cool air outlets that are respectively formed at opposite upper sides of the portion where the freezing fan 231 is located. The cool air outlet 222 for the middle compartment is configured as two cool air outlets that are respectively formed at opposite lower sides of the portion where the freezing fan 231 is located. The cool air outlet 223 for the lower compartment is configured as two cool air outlets that are respectively formed below the two cool air outlets 222 for the middle compartment.

In addition, the cool air outlet 221 for the upper compartment and the cool air outlet 222 for the middle compartment are formed in tube bodies protruding into the freezing compartment 12. A wall surface 221*b*, 222*b*, which is positioned adjacent to the freezing fan 231, of opposite side wall surfaces of each of the cool air outlet 221 for the upper compartment and the cool air outlet 222 for the middle compartment is formed to be inclined or rounded toward another wall surface of the opposite wall surfaces (referring to FIGS. 19 and 20).

This structure is provided to induce cool air flowing in the circumferential direction of the freezing fan 231 during operation of the freezing fan 231 to flow into the cool air outlet 221 for the upper compartment and the cool air outlet 222 for the middle compartment. That is, the cool air is blown while being rotated in the circumferential direction of the freezing fan 231, but the cool air outlet 221 for the upper compartment is formed to be perpendicular to a flow direction of the cool air. Accordingly, a cool air inlet side portion of each of the cool air outlet 221 for the upper compartment and the cool air outlet 222 for the middle compartment is formed to be inclined or rounded, so that the cool air efficiently flows into the cool air outlet 221 for the upper compartment and the cool air outlet 222 for the middle compartment.

Furthermore, the cool air outlet 221 for the upper compartment and the cool air outlet 222 for the middle compartment have a plurality of grilles 221*a* and 222*a* guiding the discharge direction of the cool air. At least a portion of each grille 221*a*, 222*a* is formed to be inclined toward a side wall surface of the freezing compartment 12 (referring to FIGS. 19 and 20).

That is, by the above structure, cool air discharged from the cool air outlet 221 for the upper compartment may be discharged toward opposite side wall surfaces in the upper compartment in the freezing compartment 12 and then may flow to the front in the upper compartment in the freezing compartment 12 along the opposite side wall surfaces in the upper compartment. In addition, cool air discharged from the cool air outlet 222 for the middle compartment may be discharged toward opposite side wall surfaces in the middle compartment in the freezing compartment 12 and then may flow to the front in the freezing compartment 12 along the opposite side wall surfaces in the middle compartment. Accordingly, the cool air may be sufficiently supplied to the stored item in the freezing compartment door 30*a*, 30*b*.

Furthermore, the grille panel 220 has suction guides 224*a* and 224*b* guiding the recovery flow of the cool air flowing through the freezing compartment 12. The suction guides 224*a* and 224*b* are provided in lower ends of the grille panel 220 and are configured to allow the cool air recovered after being circulated in the freezing compartment 12 to flow into a lower end of the second evaporator 42.

Each of the suction guides 224*a* and 224*b* is formed to be inclined (or rounded) at an angle the same (or similar) to a wall constituting the rear side bottom in the freezing compartment 12, as the suction guide goes to the lower end thereof. That is, the cool air flowing along a lower surface of the freezing compartment 12 may be guided by the suction guides 224*a* and 224*b* to efficiently flow to the lower end of the second evaporator 42.

In particular, the suction guides 224*a* and 224*b* includes the first suction guide 224*a*, which is provided in one side in the lower ends of the grille panel 220 on the basis of the center portion of the grille panel 220, the side where the second end 52*b* of the recovery duct 52 for the ice-making compartment is located. The suction guides 224*a* and 224*b* includes a second suction guide 224*b*, which is provided another side in the lower ends of the grille panel 220 on the basis of the center portion of the grille panel 220, the side being opposite to the first suction guide 224*a*. That is, cool air flowing through one space (a space communicating with the second end of the recovery duct for the ice-making compartment) in the freezing compartment 12 is recovered through the first suction guide 224*a*, and cool air flowing through another space in the freezing compartment 12 is recovered through the second suction guide 224*b*.

In addition, the first suction guide 224*a* is formed to be open more than the second suction guide 224*b*, and the first suction guide 224*a* is formed to have a transverse width larger than a transverse width of the second suction guide 224*b*. That is, among the two suction guides 224*a* and 224*b*, the first suction guide 224*a* at the side communicating with the recovery duct 52 for the ice-making compartment is formed to be open more than the second suction guide 224*b* at another side, so that cool air in a space at the side relatively hot side in the both spaces in the freezing compartment 12 may be rapidly recovered.

The freezing compartment side grille fan assembly 2 includes the freezing fan module 230.

The freezing fan module 230 is configured to blow cool air passing through the second evaporator 42 to the cool air flow path 214 for the freezing compartment.

The freezing fan module 230 is located in the first inlet hole 211*a*.

Figure 24:
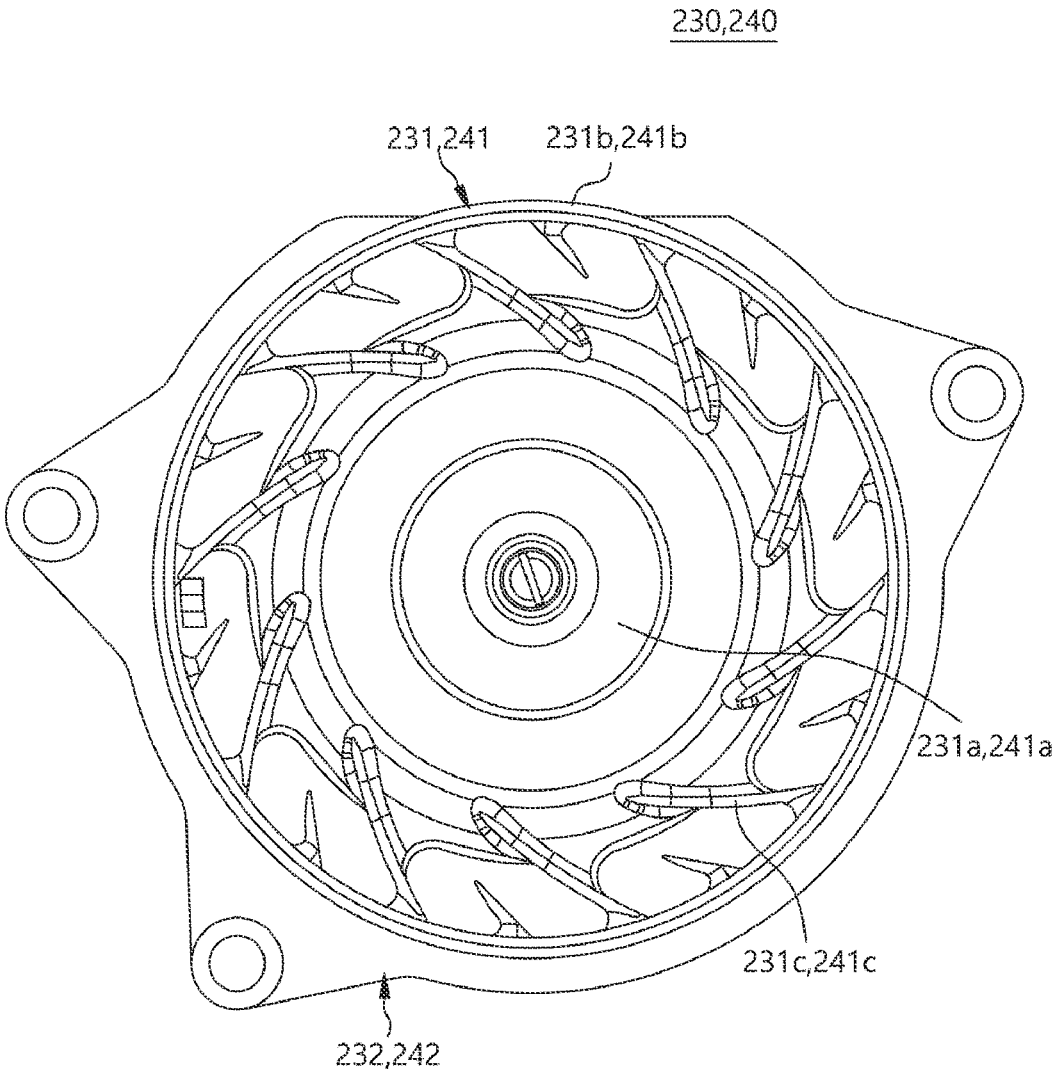
FIG. 24 is a front view showing each fan module of the refrigerator according to the embodiment of the present disclosure.
Figure 25:
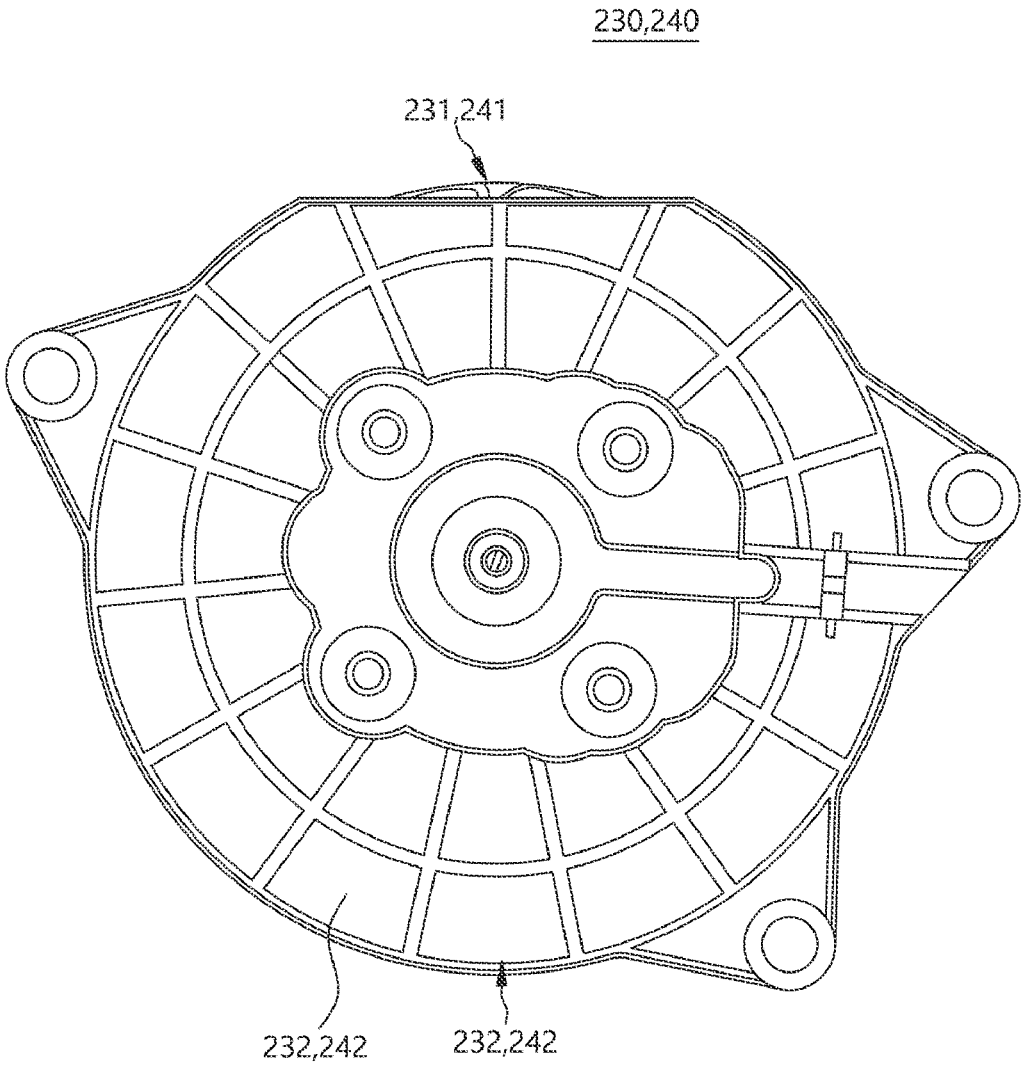
FIG. 25 is a rear view showing each fan module of the refrigerator according to the embodiment of the present disclosure.

As shown in FIGS. 24 and 25, the freezing fan module 230 includes the freezing fan 231 and a first installation frame 232.

The freezing fan 231 may be formed in a slim centrifugal fan, so that the thickness (width in the front to rear direction) of the freezing compartment side grille fan assembly 2 may be reduced.

The freezing fan 231 may include a hub part 231*a*, a rim part 231*b*, and a plurality of impellers 231*c*.

The hub part 231*a* may be a portion shaft-coupled to a fan motor (not shown), and may be formed by protruding forward (in a direction toward the cool air inlet side) as the hub part 231*a* goes to the center thereof and may be enlarged, as the hub part 231*a* goes to a rear end thereof.

The rim part 231*b* may be formed to surround a circumference of the hub part 231*a*. The rim part 231*b* is formed in a cylindrical rim.

The impellers 231*c* are provided to guide a blown direction of cool air. The impellers 231*c* are arranged to be spaced apart from each other, and each of the impellers is configured to allow cool air to pass through a gap between the impellers 231*c* while having a predetermined inclination (or curvature).

The first installation frame 232 is a portion where the freezing fan 231 is installed.

The first installation frame 232 is configured to be coupled to a plurality of fastening ribs 212*a* formed in the shroud 210. The fastening ribs 212*a* may be respectively formed at positions in consideration of the size and wind direction of the freezing fan 231.

The freezing compartment side grille fan assembly 2 includes the ice-making fan module 240.

The ice-making fan module 240 is configured to blow the cool air passing through the second evaporator 42 to the cool air flow path 213 for the ice-making compartment.

As shown in FIGS. 24 and 25, the ice-making fan module 240 includes a blowing fan 241 (Hereinbelow, the fan refers to "the ice-making fan") and a second installation frame 242.

The ice-making fan 241 may be formed in a slim centrifugal fan, so that the thickness (width in the front to rear direction) of the freezing compartment side grille fan assembly 2 may be reduced.

The ice-making fan 241 may include a hub part 241*a*, a rim part 241*b*, and a plurality of impellers 241*c*.

The hub part 241*a* may be shaft-coupled to a fan module, may be formed by protruding forward (in a direction toward the cool air inlet side) as the hub part 241*a* goes to the center thereof, and may be enlarged as the hub part 241*a* goes to a rear end thereof.

The rim part 241*b* may be formed to surround a circumference of the hub part 241*a*. The rim part 241*b* may be formed in a cylindrical rim.

The impellers 241*c* may be provided to guide a blown direction of cool air. The impellers 241*c* may be arranged to be spaced apart from each other, and each of the impellers 241*c* may be configured to allow cool air to pass through a gap between the impellers while having a predetermined inclination (or curvature).

In particular, the ice-making fan 241 may be configured as a fan of the same structure and size as the freezing fan 231 of the blower fan module 230.

That is, the ice-making fan 241 and the freezing fan 231 (or, the ice-making fan module and the blower fan module) may be used in common, so that the standardization of product design may be realized by the common use of fan modules.

The second installation frame 242 is a portion where the ice-making fan 241 is installed.

The second installation frame 242 is configured to be coupled to the plurality of the fastening ribs 212*a* formed in the shroud 210. The fastening ribs 212*a* may be respectively formed at the positions in consideration of the size and wind direction of the ice-making fan 241.

Figure 18:
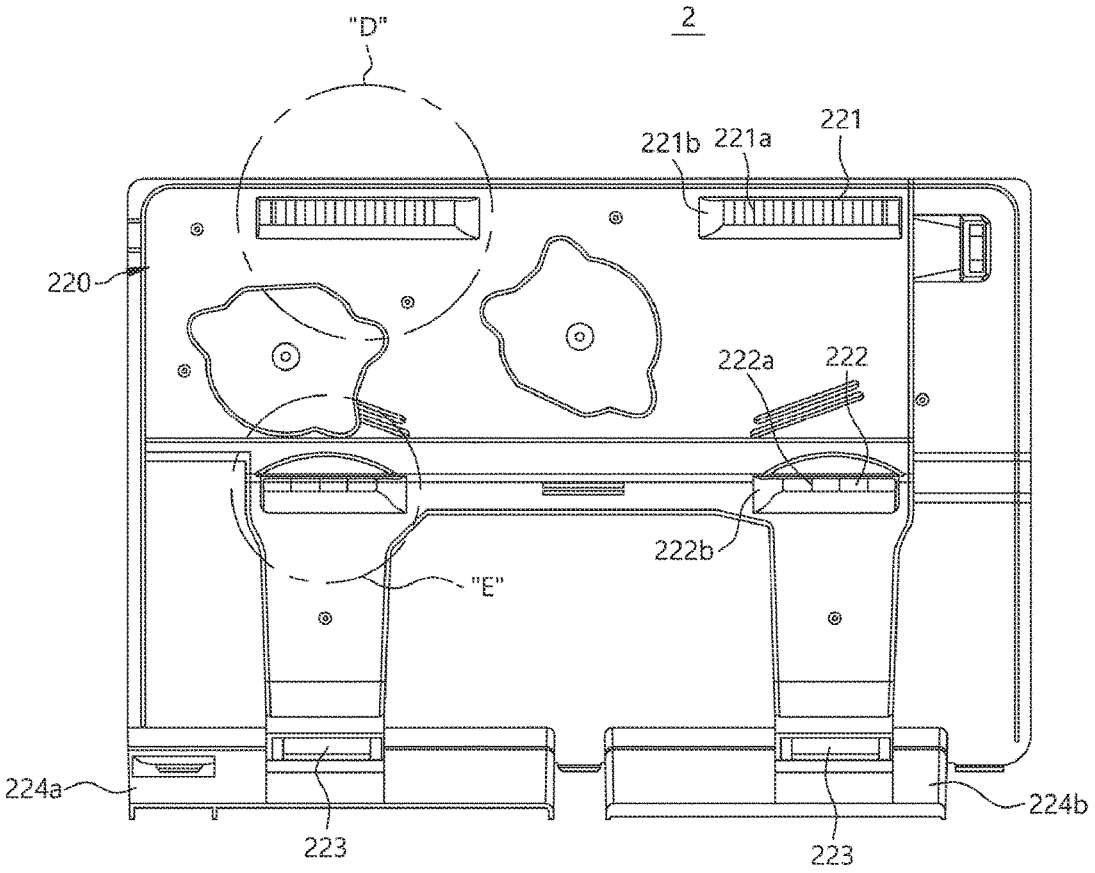
FIG. 18 is a front view showing a grille fan of the freezing compartment side grille fan assembly of the refrigerator according to the embodiment of the present disclosure.
Figure 19:
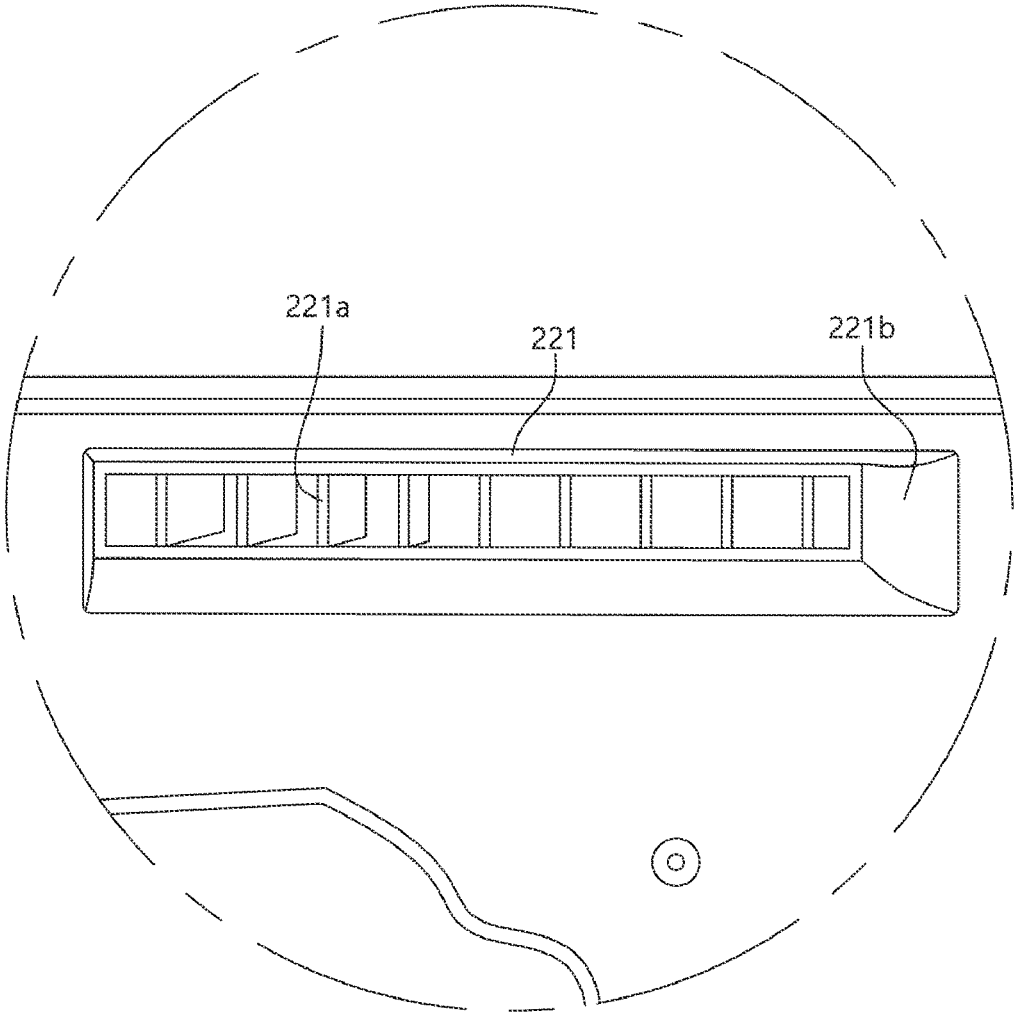
FIG. 19 is an enlarged view showing part "D" in FIG. 18.

Meanwhile, the ice-making fan module 240 is configured to be located closer to the freezing fan module 230 in comparison to the cool air outlet side of the cool air flow path 213 for the ice-making compartment (referring to FIGS. 13 and 18). That is, as the ice-making fan 241 of the ice-making fan module 240 is located to be spaced apart from the cool air outlet side (open portion) of the cool air flow path 213 for the ice-making compartment at a sufficient distance, the cool air passing through the cool air outlet side of the cool air flow path 213 for the ice-making compartment may be prevented from becoming turbulent caused when the cool air does not pass through the cool air outlet side due to the resistance of the flow of the cool air rotating along the rotational direction of the ice-making fan 241.

In addition, the ice-making fan 241 constituting the ice-making fan module 240 may be configured to rotate at a higher rotation speed than a rotation speed of the freezing fan 231 constituting the freezing fan module 230.

That is, in the case of the freezing fan 231, since the freezing fan 231 supplies the cool air to the freezing compartment 12 in front of the freezing fan 231, the freezing fan rotates at a rotation speed sufficient to provide a large air volume. However, in the case of the ice-making compartment 21, since the ice-making compartment 21 is located relatively father than the freezing compartment 12, the ice-making fan 241 is operated at a higher rotation speed than a rotation speed of the freezing fan 231, so that the cool air is forcibly supplied to the ice-making compartment 2.

In addition, the center of the ice-making fan module 240 is located lower than the center of the open portion at the cool air outlet side of the cool air flow path 213 for the ice-making compartment.

That is, based on the center portion of the ice-making fan 241, the cool air discharged upward is guided to be supplied to the ice-making compartment 21 through the cool air flow path 213 for the ice-making compartment. Considering the above structure, the center portion of the ice-making fan 241 is located lower than the center of the cool air outlet side of the cool air flow path 213 for the ice-making compartment (preferably, the lower surface of the cool air discharge portion), it is possible to allow the cool air blown from the ice-making fan 241 to be flow efficiently along the cool air flow path 213 for the ice-making compartment.

Hereinbelow, according to the embodiment of the present disclosure, the temperature control process of the freezing compartment 12 and the ice-making compartment 21 of the refrigerator will be described in detail.

Figure 26:
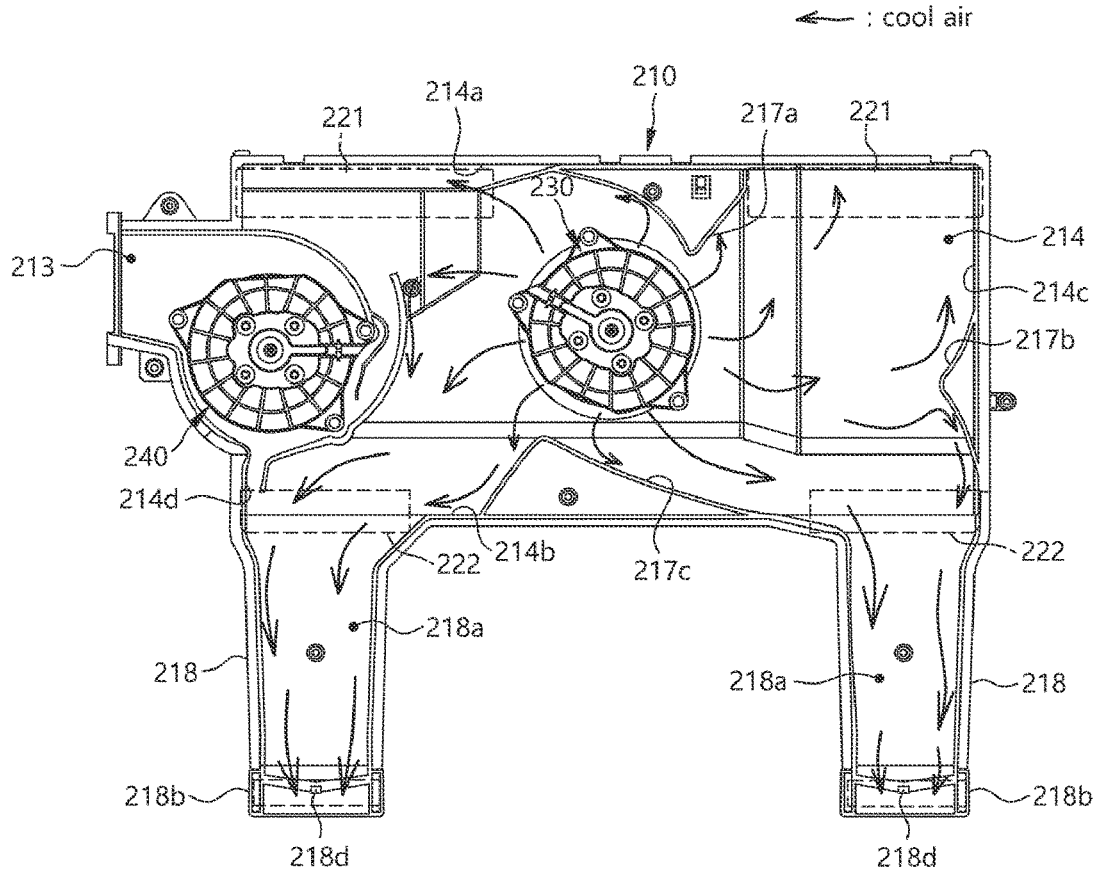
FIG. 26 is a front view of the shroud for showing a cool air flow during temperature control in the freezing compartment of the refrigerator according to the embodiment of the present disclosure.
Figure 27:
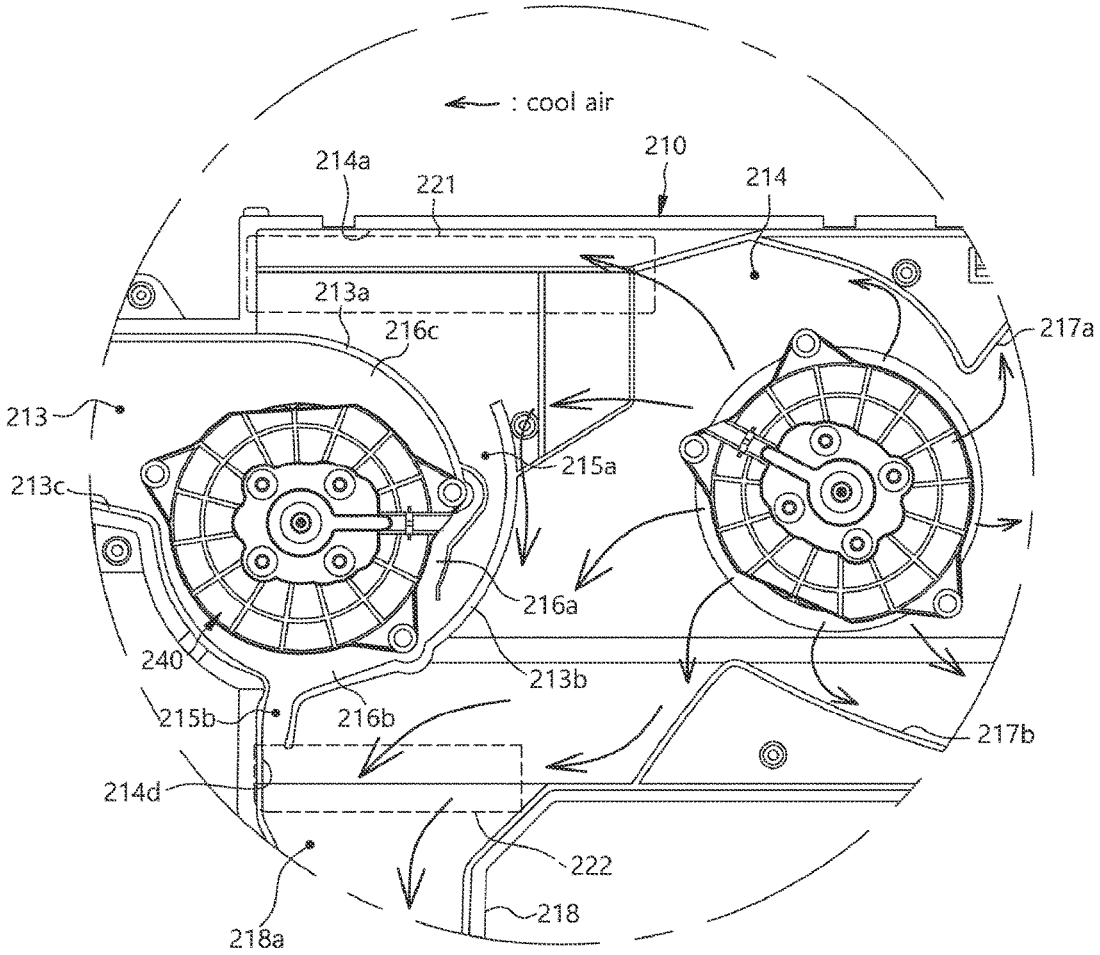
FIG. 27 is an enlarged front view of a main portion of the shroud for showing a cool air flow during temperature control in the freezing compartment of the refrigerator according to the embodiment of the present disclosure.
Figure 28:
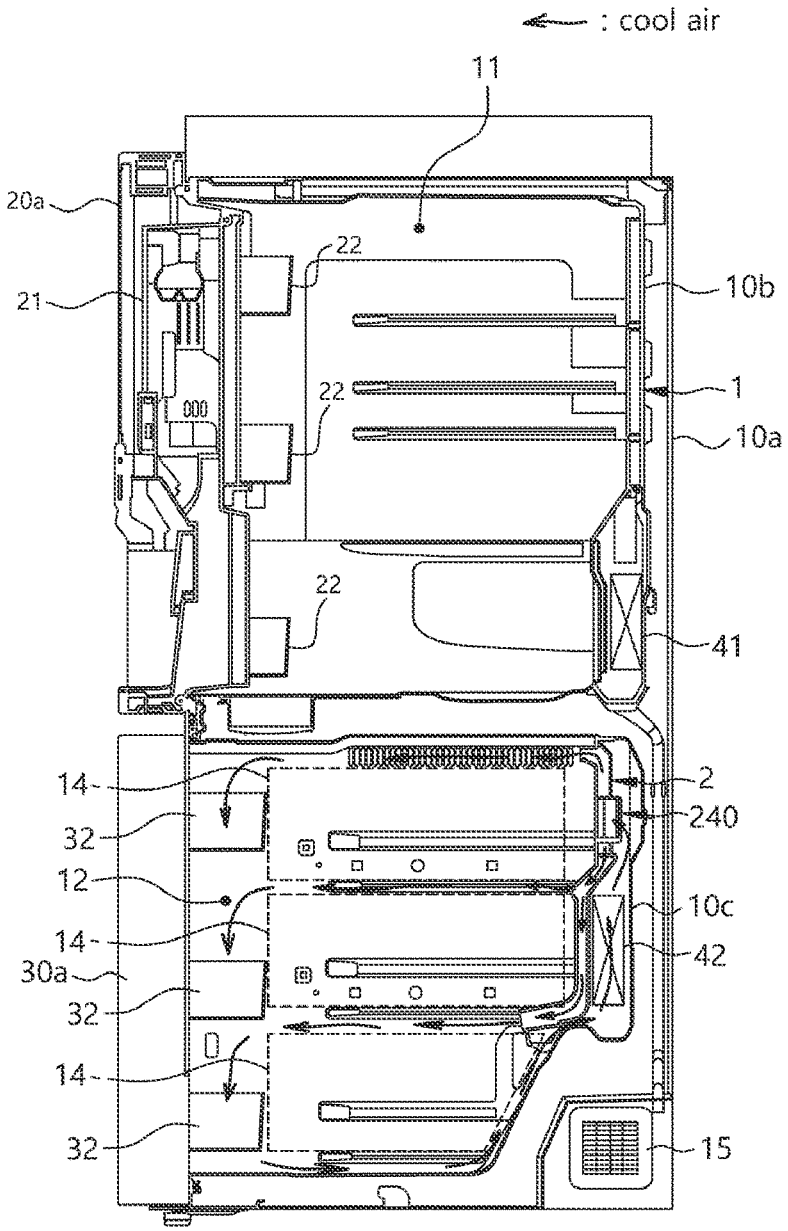
FIG. 28 is a side sectional view showing a cool air flow during the temperature control in the freezing compartment of the refrigerator according to the embodiment of the present disclosure.

The temperature control process of the freezing compartment 12 will be described with reference to FIGS. 26 to 28.

The temperature control in the freezing compartment 12 is performed by the operations of the freezing fan module 230 and the compressor (not shown). That is, operation for controlling the temperature in the freezing compartment 122 is performed by rotation of the freezing fan 231 due to power supply to the freezing fan module 230 and heat-exchange of the second evaporator 42 due to operation of the compressor.

When the freezing fan 231 of the freezing fan module 230 is operated, air in the freezing compartment 12 flows and passes through the second evaporator 42 by a blowing force of the freezing fan 231, thereby being heat-exchanged while passing through the second evaporator 42.

Further, the heat exchanged air (cool air) passes through the first inlet hole 211*a* of the shroud 210 and then flows into the cool air flow path 214 for the freezing compartment.

The cool air flowing into and blown to the upper space in the cool air flow path 214 for the freezing compartment flows into a portion where the two cool air outlet 221 for the upper compartment in the cool air flow path 214 for the freezing compartment is located by guidance of the first guide 217*a*. Continuously, the cool air is discharged to the upper compartment in the freezing compartment 12 through the cool air outlet 221 for the upper compartment.

The cool air blown to the lower side in the cool air flow path 214 for the freezing compartment flows into the portions where the two cool air outlets 222 for the middle compartment are located by guidance of the second guide 217*b*. Then, the cool air is discharged to the middle compartment in the freezing compartment 12 through the two cool air outlets 222 for the middle compartment. In the cool air flowing by the guidance of the second guide 217*b*, cool air flowing into a portion where the cool air outlet 222 for the middle compartment is located (the side opposite to the side where the ice-making fan is located) is guided in a vertical direction by the third guide 217*c* at the opposite side, a part of the cool air flows into the cool air outlet 221 for the upper compartment at the opposite side, and the remaining of the cool air flows into the cool air outlet 222 for the middle compartment at the opposite side.

In addition, the cool air flowing into the two cool air outlets 222 for the middle compartment by the guidance of the second guide 217*b* and the third guide 217*c* is partially discharged to the middle compartment in the freezing compartment 12 through the two cool air outlets 222 for the middle compartment. The remaining cool air flows into the sides where the two cool air outlets 223 for the lower compartment are located by guidance of the extension flow path 218*a*. Then, the cool air is discharged to the lower compartment in the freezing compartment 12 through the two cool air outlets 223 for the lower compartment.

Therefore, the cool air is evenly supplied to all of the upper, middle, and lower compartments of opposite sides in the freezing compartment 12.

In particular, in the cool air supplied to the freezing compartment 12, cool air discharged through the two cool air outlets 221 for the upper compartment, and the two cool air outlets 222 for the middle compartment is guided by the grilles 221*a* and 222*a* formed on the cool air outlets 221 and 222. Whereby, a part of the cool air passing through the cool air outlet 221 for the upper compartment and the cool air outlet 222 for the middle compartment is discharged toward a side wall in the freezing compartment 12 by guidance of a part of the grilles 221*a* and 222*a* and flows to a front space in the freezing compartment 12 along the side wall to be supplied to the stored item stored in the storage box 32 of the freezing compartment door 30*a*, 30*b*.

Further, the cool air supplied into the two freezing compartments 12 by passing through the cool air outlets 221, 222, and 223 flows in the freezing compartment 12, and then the two suction guides 224*a* and 224*b* formed in the grille panel 220 guides the cool air to be recovered to the cool air inlet side of the second evaporator 42.

A first suction guide 224*a* of the two suction guides 224*a* and 224*b*, the first suction guide 224*a* being located adjacent to the side communicating with the recovery duct 52 for the ice-making compartment, is formed to be larger than a second suction guide 224*b* at the opposite side. The second end 52*b* of the recovery duct 52 for the ice-making compartment is located adjacent to a side portion of the first suction guide 224*a*. Therefore, even when cool air recovered through the recovery duct 52 for the ice-making compartment is introduced into the freezing compartment 12, the cool air is directly discharged through the first suction guide 224*a*, and temperature change in the freezing compartment 12 may be minimized.

Meanwhile, during the temperature control of the freezing compartment 12, the ice-making fan 241 may also be operated.

That is, in the case of the ice-making operation, the ice-making fan 241 is set to be always operated except for special conditions (e.g., when ice is in full in the ice-making compartment). Considering the above configuration, the ice-making operation may be continuously performed during the freezing operation.

However, when the ice-making operation is performed while the freezing operation is performed, the flow of cool air flowing through the second inlet hole 211*b* and the cool air flow path 213 for the ice-making compartment in order is generated by the operation of the ice-making fan 241.

In particular, a part of the cool air generated by the operation of the ice-making fan 241 is supplied into the cool air flow path 214 for the freezing compartment through the upper shared flow path 215*a*. The remaining cool air is supplied into the ice-making compartment 21 through the cool air duct 51 for the ice-making compartment connected to the cool air flow path 213 for the ice-making compartment.

That is, cool air passing through the second inlet hole 211*b* and blown to the first area 216*a* of the cool air flow path 213 for the ice-making compartment passes through the upper shared flow path 215*a* to be supplied to the cool air flow path 214 for the freezing compartment. Cool air passing through the second inlet hole 211*b* and blown to the second area 216*b* of the cool air flow path 213 for the ice-making compartment passes through the lower shared flow path 215*b* to be supplied to the cool air flow path 214 for the freezing compartment. Cool air passing through the second inlet hole 211*b* and blown to the third area 216*c* of the cool air flow path 213 for the ice-making compartment is supplied to the ice-making compartment 21 through the cool air duct 51 for the ice-making compartment connected to the cool air outlet side of the cool air flow path 213 for the ice-making compartment.

Figure 29:
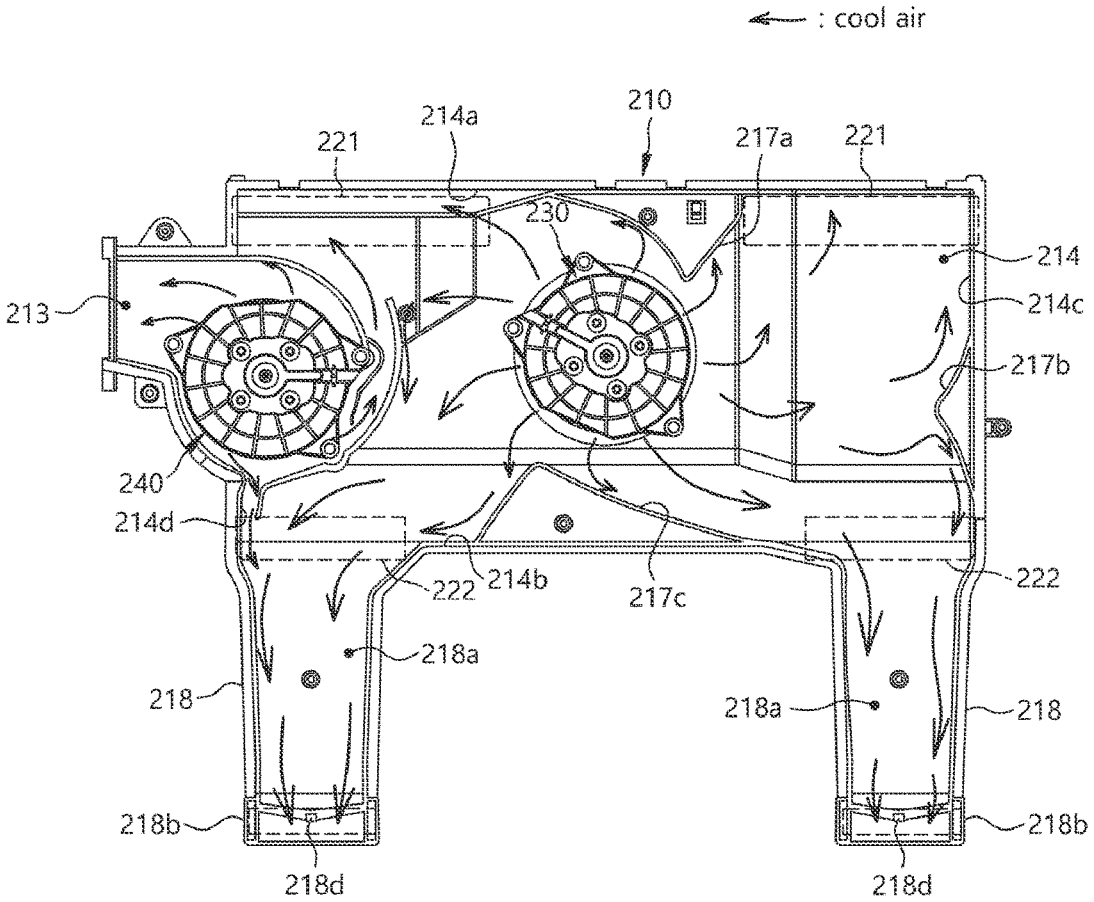
FIG. 29 is a front view of the shroud for showing a cool air flow during simultaneous operation of the freezing compartment and ice-making compartment of the refrigerator according to the embodiment of the present disclosure.
Figure 30:
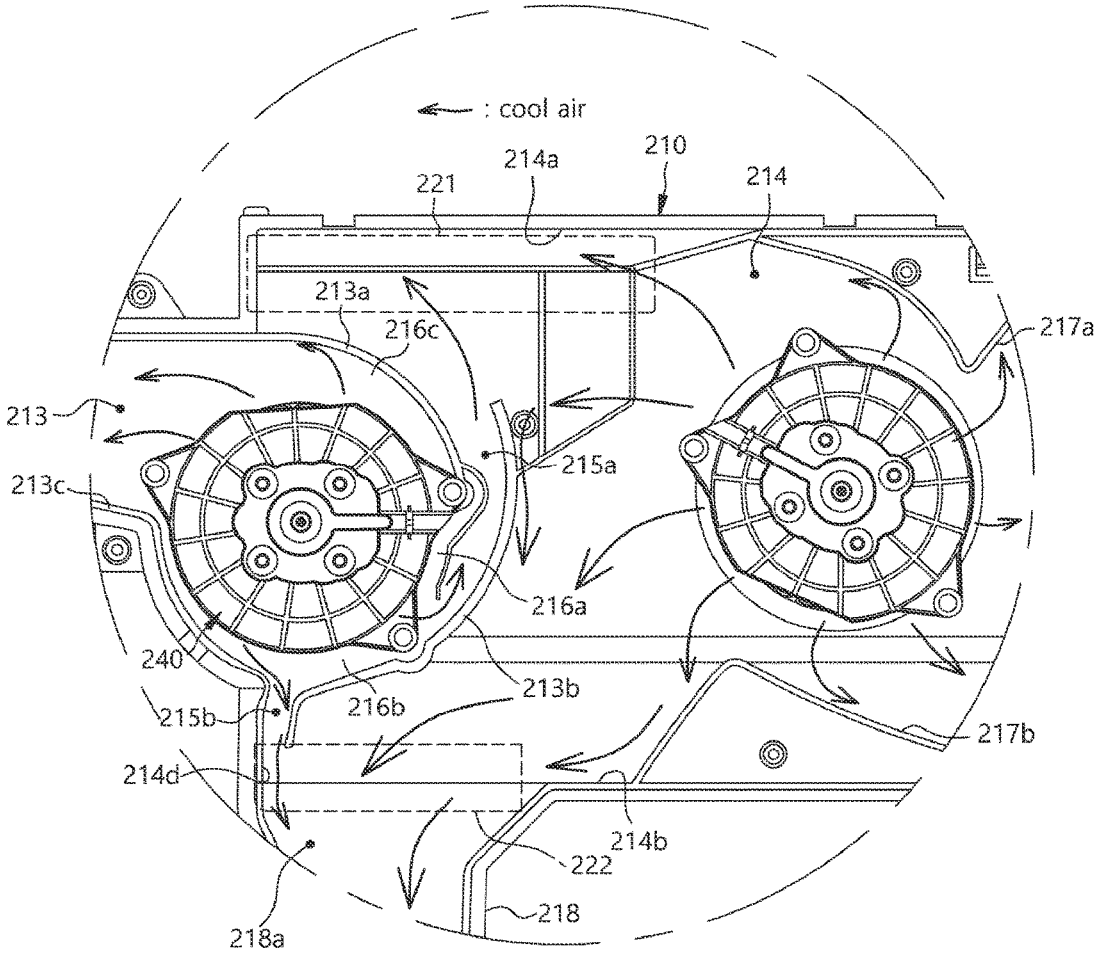
FIG. 30 is an enlarged front view of a main part of the shroud for showing a cool air flow during simultaneous operation of the freezing compartment and ice-making compartment of the refrigerator according to the embodiment of the present disclosure.

Therefore, into the freezing compartment 12, not only the cool air blown by the operation of the freezing fan 231 but also the cool air blown by the operation of the ice-making fan 241 is supplied, so that sufficient cool air may be supplied into the freezing compartment 12. The above structure is as shown in FIGS. 29 and 30.

In particular, the cool air supplied through the upper shared flow path 215*a* is provided to the upper compartment of one space in the both side spaces in the freezing compartment 12, the space at a side communicating with the recovery duct 52 for the ice-making compartment, and the cool air supplied through the lower shared flow path 215*b* is provided to a lower compartment of one space in the both side spaces of the freezing compartment 12, the space at a side communicating with the recovery duct 52 for the ice-making compartment. Considering the above flows, the space at a side communicating with the recovery duct 52 for the ice-making compartment is supplied with a larger amount of cool air than another space opposite to the space. Accordingly, even when the recovery duct 52 for the ice-making compartment is connected to one of opposite spaces in the freezing compartment 12, the opposite spaces in the freezing compartment 12 may be maintained within the same (or similar) temperature range.

Further, when the freezing operation (or ice-making operation) is performed or each operation is stopped, condensed water is generated due to temperature difference between the cool air flow path 213 for the ice-making compartment and the refrigerating compartment 11, or the cool air duct 51 for the ice-making compartment and the refrigerating compartment 11. The generated condensed water flows down the second circumferential flow path rib 213*b* of the cool air flow path 213 for the ice-making compartment along the cool air duct 51 for the ice-making compartment.

Then, the condensed water flows down the extension flow path 218*a* through the lower shared flow path 215*b* formed in the second circumferential flow path rib 213*b*. Continuously, the condensed water flows along the extension flow path 218*a* and is discharged to the outside of the freezing compartment side grille fan assembly 2 through the drainage hole 218*d* formed in the extension flow path 218*a* where the condensed water flows.

Accordingly, a malfunction of the ice-making fan 241 due to the condensed water freezing in the cool air flow path 213 for the ice-making compartment without being drained may be prevented.

Hereinbelow, the operation for controlling the temperature in the ice-making compartment 21 (ice-making operation) will be described with reference to FIGS. 31 to 34.

The temperature control of the ice-making compartment 21 is performed by the operation of the ice-making fan 241 due to power supply to the ice-making fan module 240. At this time, the compressor may be operated or stopped in response to the operating conditions of the freezing compartment 12.

Figure 31:
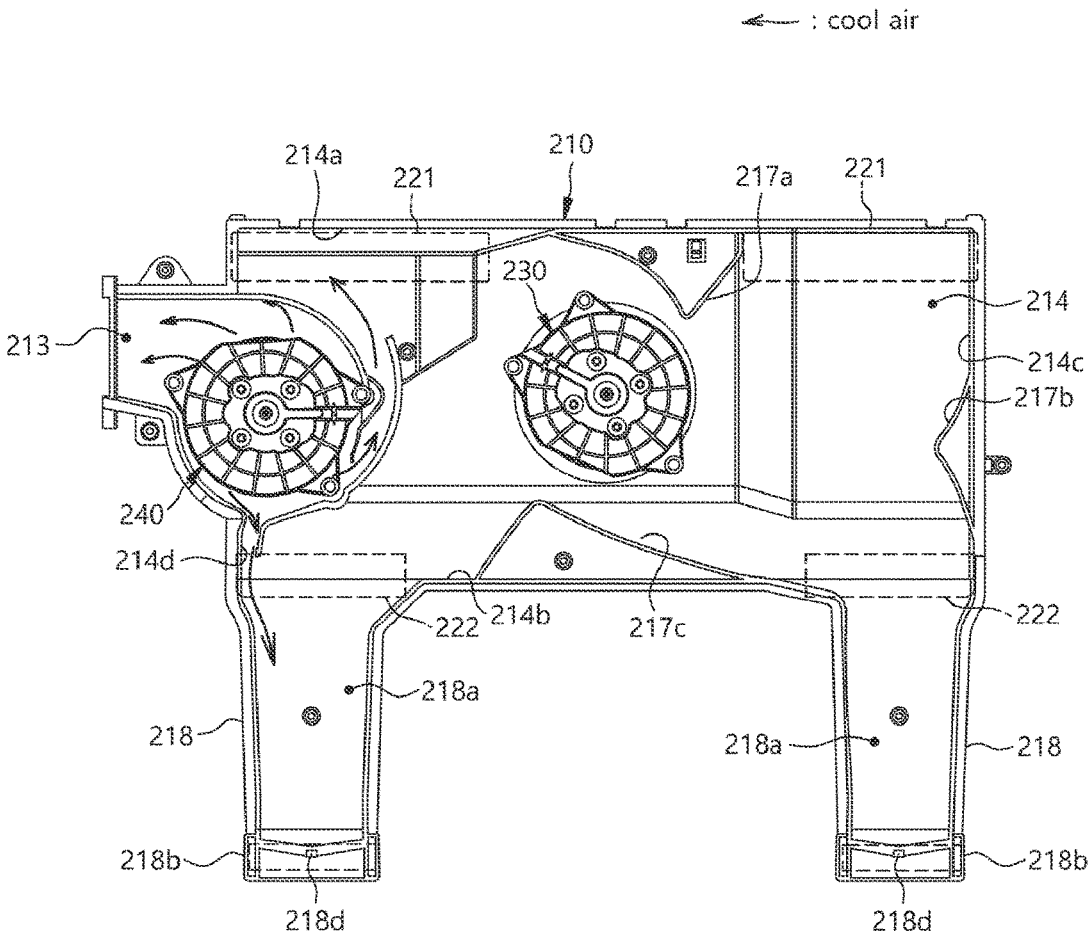
FIG. 31 is a front view of the shroud for showing a cool air flow during temperature control in the ice-making compartment of the refrigerator according to the embodiment of the present disclosure.
Figure 32:
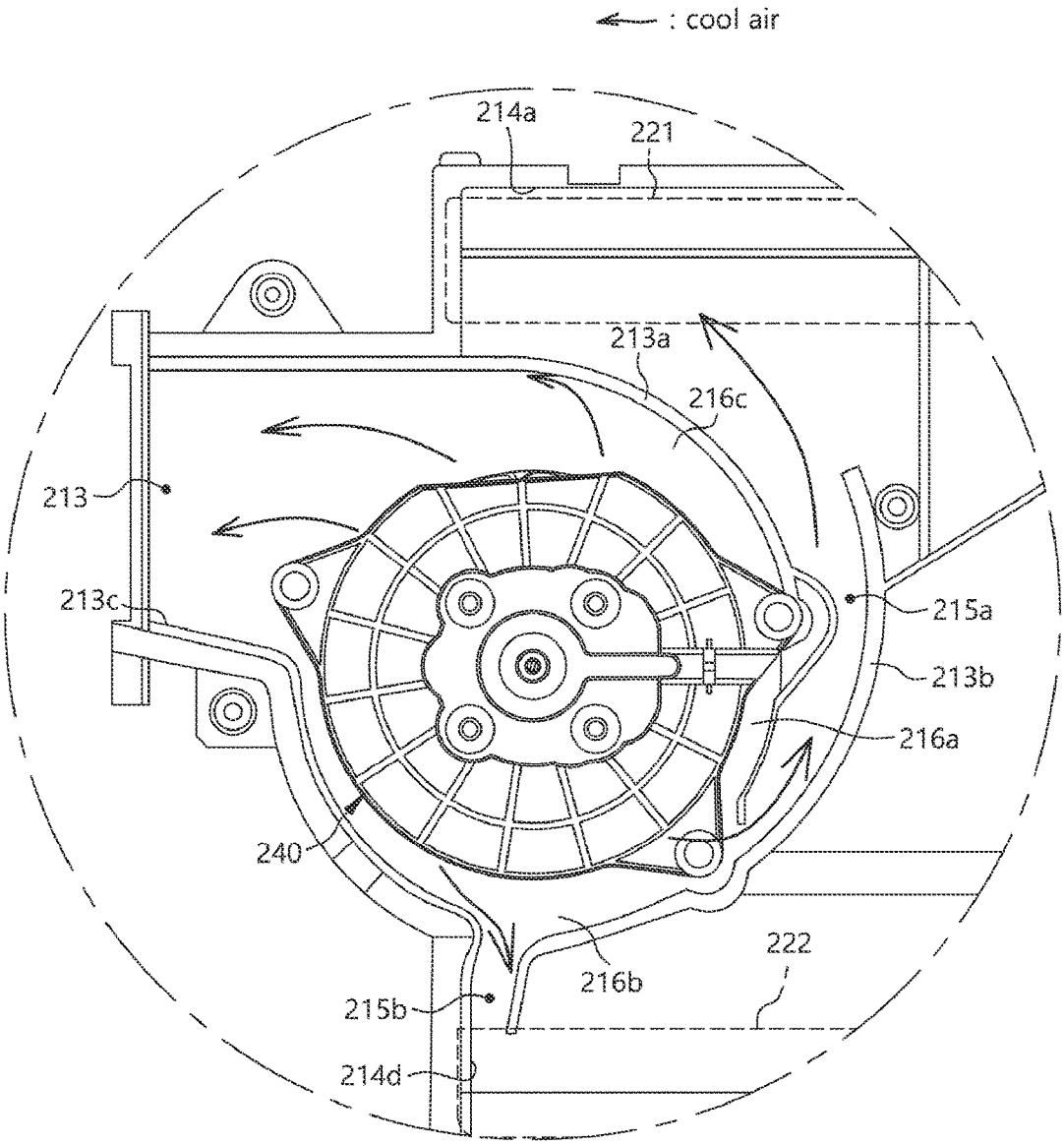
FIG. 32 is an enlarged front view of a main portion of the shroud for showing a cool air flow during temperature control in the ice-making compartment of the refrigerator according to the embodiment of the present disclosure.

When the ice-making fan 241 is operated, air in the freezing compartment 12 passes through the second evaporator 42 and passes through the second inlet hole 211*b* of the shroud 210 by the air blowing force of the ice-making fan 241, and then flows into the first area 216*a*, the second area 216*b*, and the third area 216*c* of the cool air flow path 213 for the ice-making compartment. Continuously, the air is discharged from the cool air flow path 213 for the ice-making compartment through the communication portions with the areas 216*a*, 216*b*, and 216*c*. The above operation is as shown in FIGS. 31 and 32.

The cool air flowing into the first area 216*a* by the operation of the ice-making fan 241 passes through the upper shared flow path 215*a* to be supplied to the upper surface side of the cool air flow path 214 for the freezing compartment. The cool air blown to the second area 216*b* passes through the lower shared flow path 215*b* to be supplied to the extension flow path 218*a*. The cool air blown to the third area 216*c* passes through the cool air duct 51 for the ice-making compartment to be supplied to the ice-making compartment 21.

Figure 33:
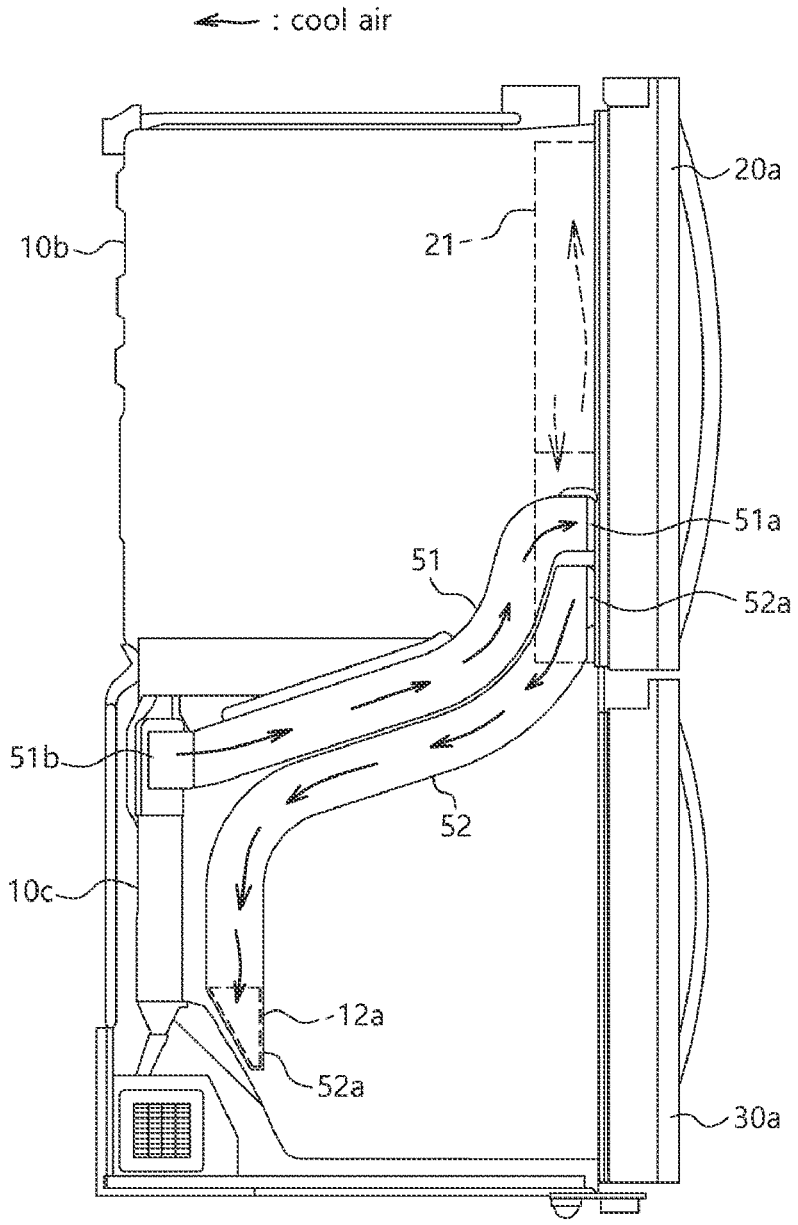
FIG. 33 is a side view showing a cool air flow during temperature control in the ice-making compartment of the refrigerator according to the embodiment of the present disclosure.
Figure 34:
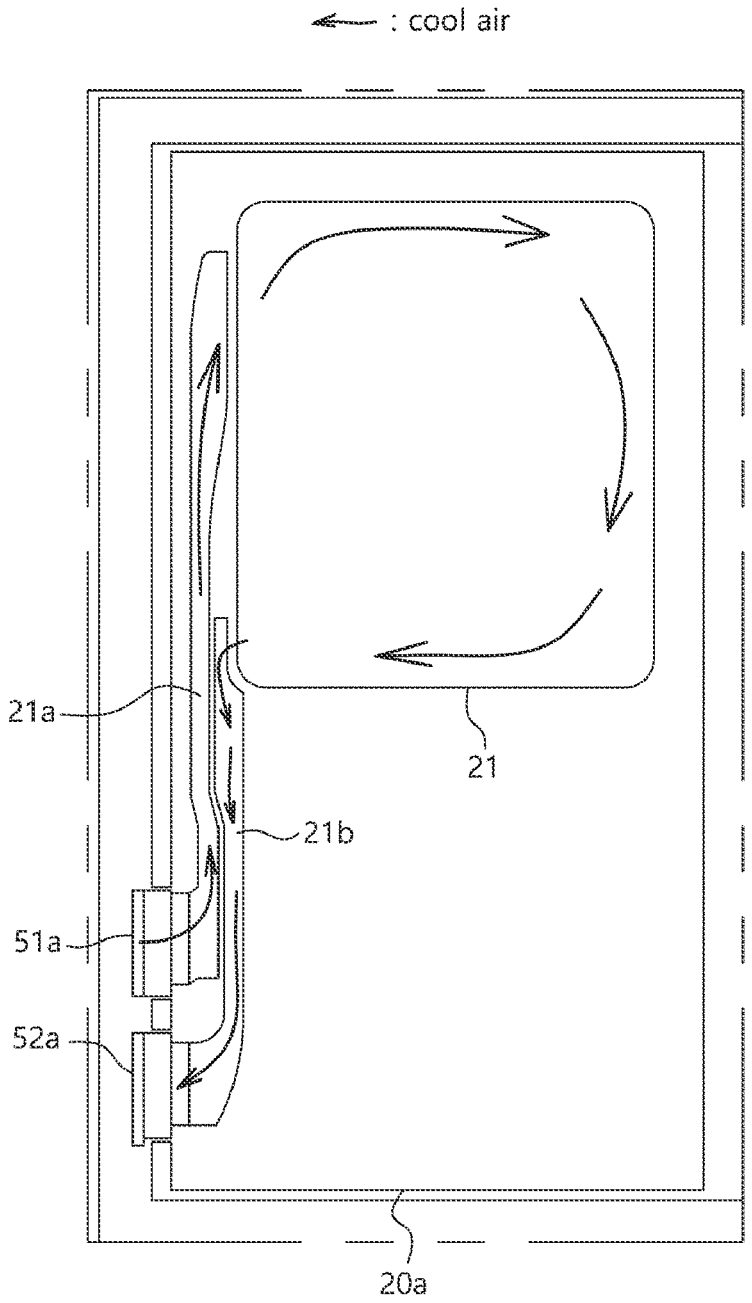
FIG. 34 is a view schematically showing a cool air flow in the ice-making compartment during temperature control in the ice-making compartment of the refrigerator according to the embodiment of the present disclosure.

In addition, the cool air passing through the upper shared flow path 215*a* and supplied to the cool air flow path 214 for the freezing compartment is supplied to the freezing compartment 12 through the cool air outlet 221 for the upper compartment while being blown toward the cool air outlet 221 for the upper compartment in the cool air flow path 214 for the freezing compartment. The cool air passing through the lower shared flow path 215*b* and supplied to the cool air flow path 214 for the freezing compartment is supplied to the freezing compartment 12 through the cool air outlet 223 for the lower compartment while flowing along the side wall surface of the extension flow path 218*a*. The above operations are as shown in FIGS. 33 and 34.

In particular, the cool air passing through the second inlet hole 211*b* and supplied to the cool air flow path 213 for the ice-making compartment by the air blowing force of the ice-making fan 241 is discharged to the third area 216*c*, which is the upper portion of the ice-making fan 241, and then the cool air flows along the cool air flow path 213 for the ice-making compartment into the cool air outlet side. At this time, since the cool air flows along a sufficient distance from the third area 216*c* to the cool air outlet side, the flow resistance caused by the third area 216*c* and the cool air outlet side adjacent to each other may be reduced.

Accordingly, the inside of the freezing compartment 12 maintains a pressure state similar to a pressure state of the cool air flow path 213 for the ice-making compartment by the cool air supplied through the upper shared flow path 215*a* and the lower shared flow path 215*b*. That is, since the pressures of the freezing compartment 12 and the ice-making compartment 21 are roughly balanced, even when only the ice-making fan 241 is operated for the ice-making operation, the cool air in the freezing compartment 12 may be prevented from (or, be minimized in) passing through the cool air flow path 214 for the freezing compartment and the first inlet hole 211*a* in reverse and flowing into the second inlet hole 211*b* and the cool air flow path 213 for the ice-making compartment.

Meanwhile, when the cool air heat-exchanged while passing through the second evaporator 42 passes through the second inlet hole 211*b* and is discharged in the radial direction of the ice-making fan 241, the cool air may pass through the second inlet hole 211*b* in reverse due to the flow resistance.

However, the second inlet hole 211*b* is configured to cover each impeller 241*c* of the ice-making fan 241 (or, to cover at least half of each impeller), so that the cool air blown from the ice-making fan 241 is prevented from a backflow in which the cool air is discharged through the second inlet hole 211*b*. Furthermore, the cool air may be blown to the cool air flow path 213 for the ice-making compartment with a blowing pressure higher than a blowing pressure of the cool air passing through the first inlet hole 211*a* and blown along the cool air flow path 214 for the freezing compartment.

By the high blowing pressure, the cool air is efficiently supplied to the ice-making compartment 21 through the cool air duct 51 for the ice-making compartment connected to the cool air flow path 213 for the ice-making compartment.

In addition, the cool air discharged to the third area 216*c* flows toward the second area 216*b* located in the rotating direction of the ice-making fan 241. However, considering that the third area 216*c* and the second area 216*b* are partitioned from each other by the ice-making fan module 240, the entire cool air discharged to the third area 216*c* flows toward the cool air outlet side of the cool air flow path 213 for the ice-making compartment by the guidance of the cool air flow path 213 for the ice-making compartment.

Accordingly, the amount of the cool air supplied to the ice-making compartment 21 is less than that of the cool air supplied to the freezing compartment 12, but the cool air supplied to the ice-making compartment 21 may be efficiently forced-supplied to the ice-making compartment 21 by the high blowing pressure.

Further, the cool air supplied to the ice-making compartment 21 freezes water (or other beverages) in an ice tray (not shown) while flowing in the ice-making compartment 21.

The cool air flowing in the ice-making compartment 21 flows into the recovery duct 52 for the ice-making compartment. Continuously, the cool air is recovered to the freezing compartment 12 by guidance of the recovery duct 52 for the ice-making compartment.

Then, the cool air recovered to the freezing compartment 12 is directly suctioned into the first suction guide 224*a* located opposite to the freezing compartment 12 and is recovered to the cool air inlet side of the second evaporator 42.

Accordingly, the temperature in the ice-making compartment 21 is controlled by the above-described repeated circulation of air (cool air).

As a result, the shared flow paths 215*a* and 215*b* are provided in the refrigerator of the present disclosure, so that the cool air flow path 214 for the freezing compartment and the cool air flow path 213 for the ice-making compartment are shared with each other. Accordingly, even when the freezing fan 231 and the ice-making fan 241 are operated at the same time, not only cool air may be sufficiently supplied to the freezing compartment 12, but also the backflow of cool air from the freezing compartment 12 may be prevented when only the ice-making fan 241 is operated.

The refrigerator of the present disclosure is configured such that the open portion of the cool air outlet side of the shared flow path 215*a*, 215*b* does not face the freezing fan module 230. Accordingly, the cool air provided from the cool air flow path 213 for the ice-making compartment through the shared flow path 215*a*, 215*b* does not interfere with the flow of the cool air flowing in the cool air flow path 214 for the freezing compartment.

The refrigerator of the present disclosure is configured such that the cool air flow path 213 for the ice-making compartment and the cool air flow path 214 for the freezing compartment are integrally formed on the shroud 210, and each cool air flow path 213, 214 is designed in consideration of the structure of each fan module 230, 240. Accordingly, common use of the ice-making fan module 240 and the freezing fan module 230 may be realized.

The refrigerator of the present disclosure is configured such that the lower shared flow path 215*b* is formed in a lower surface (the second circumferential flow path rib) of the installation portion of the ice-making fan module 240, and the extension flow path 215*a*, 215*b* extended to the lower compartment of the freezing compartment 12 is additionally formed in the shroud 210, so that sufficient cool air may be supplied to the lower compartment of the freezing compartment 12. In particular, the drainage hole 218*d* is additionally formed in the extension flow path 218*a*, and the lower shared flow path 215*b* is formed by penetrating between the second circumferential flow path rib 213*b* and the wall surface of the shroud 210, so that condensed water or moisture in the installation portion of the ice-making fan module 240 may be efficiently discharged to the outside of the freezing compartment 12.

The refrigerator of the present disclosure is configured to have the guide 217*a*, 217*b*, 217*c* formed on each wall surface 214*a*, 214*b*, 214*c*, 214*d* in the cool air flow path 214 for the freezing compartment. Accordingly, the cool air flowing in the cool air flow path 214 for the freezing compartment may be supplied differently for each portion in the freezing compartment 12, thereby improving the freezing efficiency.

The invention claimed is:

1. A refrigerator comprising:

a cabinet having a refrigerating compartment and a freezing compartment;

a refrigerating compartment door comprising an ice-making compartment; and a grille fan assembly that is disposed at the freezing compartment and comprises a freezing fan and an ice-making fan, the grille fan assembly defining:

a first cool air flow path configured to guide air blown by the freezing fan toward the freezing compartment, a second cool air flow path configured to guide air blown by the ice-making fan toward the ice-making compartment, and a shared flow path that is in fluid communication with the first cool air flow path and the second cool air flow path, the shared flow path having a cool air outlet that is open in a direction away from the freezing fan, wherein an open portion of the cool air outlet of the shared flow path does not face the freezing fan.

2. The refrigerator of claim 1, wherein the grille fan assembly further comprises:

a grille panel that defines a front wall surface of the grille fan assembly exposed to an inside of the freezing compartment; and a shroud that defines a rear wall surface of the grille fan assembly coupled to a rear surface of the grille panel, and wherein the first cool air flow path and the second cool air flow path are defined in at least one of the rear surface of the grille panel or a front surface of the shroud that faces the rear surface of the grille panel.

3. The refrigerator of claim 2, wherein the grille panel defines:

an upper cool air outlet located above the freezing fan and configured to discharge air to an upper portion of the freezing compartment;

a middle cool air outlet located below the freezing fan and configured to discharge air to a middle portion of the freezing compartment; and a lower cool air outlet located below the middle cool air outlet and configured to discharge air to a lower portion of the freezing compartment.

4. The refrigerator of claim 3, wherein each of the upper cool air outlet and the middle cool air outlet includes wall surfaces that define a tube shape protruding into the freezing compartment, and wherein one of the wall surfaces faces the freezing fan and is inclined or rounded toward another of the wall surfaces.

5. The refrigerator of claim 3, wherein at least one of the upper cool air outlet, the middle cool air outlet, or the lower cool air outlet comprises a plurality of grilles that are configured to define a discharge direction of air, and wherein a portion of the plurality of grilles are configured to discharge air toward any one of walls of the freezing compartment.

6. The refrigerator of claim 2, wherein the grille panel comprises a plurality of suction guides that are disposed at lower ends of the grille panel and open toward the inside of the freezing compartment, the plurality of suction guides being configured to introduce air from the freezing compartment toward an evaporator and defining openings that have different sizes from each other.

7. The refrigerator of claim 2, wherein the first cool air flow path is recessed from the front surface of the shroud, wherein the second cool air flow path is defined at a side of the first cool air flow path in the front surface of the shroud, and wherein the shroud further defines:

a first inlet hole that receives the freezing fan and is in fluid communication with the first cool air flow path, and a second inlet hole that receives the ice-making fan and is in fluid communication with the second cool air flow path.

8. The refrigerator of claim 7, wherein the shroud comprises a plurality of wall surfaces that define the first cool air flow path, the plurality of wall surfaces comprising:

an upper wall surface located at an upper side of the first inlet hole;

a lower wall surface located at a lower side of the first inlet hole; and a first side wall surface and a second side wall surface that are spaced apart from each other and face each other, the second side wall surface facing the second cool air flow path.

9. The refrigerator of claim 8, wherein the second inlet hole passes through the shroud and is defined at a position closer to the second side wall surface than to the first side wall surface, and wherein the second cool air flow path extends from the second inlet hole and protrudes outward from the second side wall surface.

10. The refrigerator of claim 8, wherein the shroud further comprises an upper guide disposed at the upper wall surface and configured to guide a flow of air from the first inlet hole into the first cool air flow path, the upper guide being configured to guide the flow of air toward opposite sides of an upper portion of the freezing compartment.

11. The refrigerator of claim 10, wherein the upper guide has a triangular shape having an inclined or rounded surface that extends upward from a vertex portion facing the first inlet hole, and wherein a width of the upper guide increases as the upper guide extends upward from the vertex portion toward the upper wall surface.

12. The refrigerator of claim 11, wherein the vertex portion of the upper guide is offset from a center of the first inlet hole toward the first side wall surface.

13. The refrigerator of claim 8, wherein the shroud further comprises a lower guide that is disposed at the lower wall surface and configured to guide a flow of air from the first inlet hole into the first cool air flow path, the lower guide being configured to guide the flow of air toward opposite sides of a lower portion of the freezing compartment.

14. The refrigerator of claim 13, wherein the lower guide has a triangular shape having an inclined or rounded surface that extends downward from a vertex portion facing the first inlet hole, and wherein a width of the lower guide increases as the lower guide extends downward from the vertex portion toward the lower wall surface.

15. The refrigerator of claim 8, wherein the shroud further comprises a side guide that is disposed at the first side wall surface and configured to guide a flow of air from the first inlet hole into the first cool air flow path, the side guide being configured to guide the flow of air toward upper and lower sides of a side portion of the freezing compartment.

16. A refrigerator of comprising:

a cabinet having a refrigerating compartment and a freezing compartment;

a refrigerating compartment door comprising an ice-making compartment; and a grille fan assembly that is disposed at the freezing compartment and comprises a freezing fan and an ice-making fan, the grille fan assembly defining:

a first cool air flow path configured to guide air blown by the freezing fan toward the freezing compartment, a second cool air flow path configured to guide air blown by the ice-making fan toward the ice-making compartment, and a shared flow path that is in fluid communication with the first cool air flow path and the second cool air flow path, the shared flow path having a cool air outlet that is open in a direction away from the freezing fan, wherein the shared flow path comprises:

an upper shared flow path configured to supply a part of air in the second cool air flow path to an upper space of the first cool air flow path based on operation of the ice-making fan.

17. The refrigerator of claim 16, wherein the grille fan assembly further comprises a flow path rib that separates the first cool air flow path and the second cool air flow path from each other, a portion of the flow path rib defining the upper shared flow path.

18. The refrigerator of claim 17, wherein the flow path rib comprises:

a first circumferential flow path rib that surrounds an upper circumference of the ice-making fan; and a second circumferential flow path rib that surrounds a lower circumference of the ice-making fan.

19. A refrigerator of comprising:

a cabinet having a refrigerating compartment and a freezing compartment;

a refrigerating compartment door comprising an ice-making compartment; and a grille fan assembly that is disposed at the freezing compartment and comprises a freezing fan and an ice-making fan, the grille fan assembly defining:

a first cool air flow path configured to guide air blown by the freezing fan toward the freezing compartment, a second cool air flow path configured to guide air blown by the ice-making fan toward the ice-making compartment, a shared flow path that is in fluid communication with the first cool air flow path and the second cool air flow path, the shared flow path having a cool air outlet that is open in a direction away from the freezing fan, and extension flow paths that extend from ends of a lower side of the first cool air flow path toward a lower portion of the freezing compartment, one of the extension flow paths being disposed below the second cool air flow path, wherein the shared flow path comprises a lower shared flow path that is configured to supply a part of air from the second cool air flow path toward at least one of the extension flow paths based on operation of the ice-making fan.

20. The refrigerator of claim 19, wherein the grille fan assembly further comprises:

a first circumferential flow path rib that surrounds an upper circumference of the ice-making fan; and a second circumferential flow path rib that surrounds a lower circumference of the ice-making fan, wherein the grille fan assembly further comprises a side wall surface that defines a portion of the first cool air flow path, wherein the second cool air flow path is disposed at the side wall surface, and wherein the lower shared flow path includes a space defined between a lower end of the second circumferential flow path rib and the side wall surface.

* * * * *